US006450090B1

(12) United States Patent
Wridge, Jr.

(10) Patent No.: US 6,450,090 B1
(45) Date of Patent: Sep. 17, 2002

(54) SYSTEM AND METHOD FOR PRINTING DIRECTLY ON A MAT BOARD

(76) Inventor: Wilbur S. Wridge, Jr., 6829 122nd Ave. NE., Kirkland, WA (US) 98033

( * ) Notice: Subject to any disclaimer, the term of this patent is extended or adjusted under 35 U.S.C. 154(b) by 0 days.

(21) Appl. No.: 09/562,582

(22) Filed: May 1, 2000

Related U.S. Application Data

(60) Provisional application No. 60/200,923, filed on May 1, 2000.

(51) Int. Cl.[7] ..... B41F 17/08; B41J 11/44

(52) U.S. Cl. ..... 101/40; 101/484; 400/76; 400/70; 400/61

(58) Field of Search ..... 101/40, 484; 400/76, 400/70, 61

(56) References Cited

U.S. PATENT DOCUMENTS

| | | | | |
|---|---|---|---|---|
| 4,165,408 A | | 8/1979 | Pierce | |
| 4,301,199 A | | 11/1981 | Pfanstiehl | |
| 5,072,532 A | | 12/1991 | Kelly | |
| 5,383,996 A | | 1/1995 | Dressler | |
| 5,404,663 A | | 4/1995 | Schober | |
| 5,473,740 A | | 12/1995 | Kasson | |
| 5,600,412 A | * | 2/1997 | Connors | 399/81 |
| 5,720,123 A | | 2/1998 | Taylor | |
| 5,733,081 A | | 3/1998 | Dowdle et al. | |
| 5,806,218 A | | 9/1998 | Shanks et al. | |
| 5,831,747 A | * | 11/1998 | Salgado | 358/453 |
| 5,916,650 A | | 6/1999 | Rosenbaum et al. | |
| 5,924,870 A | | 7/1999 | Brosh et al. | |

OTHER PUBLICATIONS

IBM Technical Disclosure Bulletin, vol. 36, Issue 12, pp. 577–578, Dec. 1993.*

Users Manual entitled "Wizard Mat Cutting System", Software Version 4.0, Rev. A (date dependent or section), Mar. 2000.

* cited by examiner

*Primary Examiner*—Andrew H. Hirshfeld
*Assistant Examiner*—Charles H. Nolan, Jr.
(74) *Attorney, Agent, or Firm*—Perkins Coie LLP

(57) ABSTRACT

A system and method for printing directly on a mat board. A computer-readable medium includes a digital image having a size scaled to a size of the mat board. For example, the size can correspond to a border region of the mat board between an outer edge of the mat board and an interior region of the mat board that is open or configured to be open to allow visual access to a selected item placed behind the mat board. The digital image is transmitted to a computer printer coupled to the computer-readable medium, and the digital image is printed directly on the mat board with the computer printer while the mat board is engaged with the computer printer. The mat board can include a mat board body having a forward-facing surface with an at least partially non-porous print receiving medium configured to receive ink from an ink jet printer, and a generally non-porous medium at a rearward-facing surface configured to at least restrict moisture from passing into the mat board body through the rearward-facing surface.

39 Claims, 35 Drawing Sheets

SYSTEM AND METHOD FOR PRINTING DIRECTLY ON A MAT BOARD

CROSS REFERENCE TO RELATED APPLICATION

This application claims priority to Provisional U.S. Application No. 60/200,923, titled "Method and Apparatus for Printing and Cutting Mat Boards," filed May 1, 2000.

TECHNICAL FIELD

The following relates generally to printing, and more particularly, to printing images directly on a mat board.

BACKGROUND OF THE INVENTION

Mat boards are typically used in the picture framing industry to provide a border between the inner edge of a picture frame and the outer edge of the picture. Mat boards are typically made of a relatively stiff cardboard stock that has a protective backing to reduce the likelihood for warping. The front face of the mat board is typically colored and/or textured in a manner that makes it easier for viewers to move their eyes back and forth between the frame and picture. Accordingly, the mat board can add to the overall aesthetic impression formed by the framed picture.

Conventional mat boards initially have a white or otherwise neutrally colored face. The face of each mat board is then colored and/or textured using one or more of a variety of conventional techniques. For example, one conventional technique includes hand-painting the mat board with brushes, rollers, or other known painting methods. If the mat board includes text (such as a title for the picture), the text is also applied to the mat board by hand, for example, by hand-printing or stamping the text on the mat board or transferring adhesive labels to the mat board. If the mat board includes French lines, these lines are typically applied using adhesive tape or a computer plotter. However, if the lines are thick and/or have an internal pattern or texture, these techniques may not be adequate. Accordingly, broad or textured French lines are typically daubed onto the mat board by hand.

One problem with the foregoing methods for treating the mat boards is that they are expensive, time consuming, and cumbersome. For example, it can be costly and time consuming to custom hand-paint each mat board. Alternatively, it is costly to maintain a stock of pre-printed mat boards because of the sheer number of mat board color and texture combinations required to be compatible with a wide variety of frames and pictures. Furthermore, the pre-printed mat boards may still require hand-applied lettering and/or French lines, further adding to the cost of the picture framing process.

SUMMARY

An embodiment of the present invention provides a method and system for printing on a mat board, used for mounting and/or framing a selected item such as a picture. The method can include providing on a computer-readable medium, a digital image having a size scaled to the size of the mat board and transmitting the digital image to a computer printer coupled to the computer-readable medium. The method can further include printing the digital image directly on the mat board with the computer printer while the mat board is engaged with the computer printer. The digital image can be provided by scanning an image with a computer scanner, and can be manipulated before being transmitted to the computer printer. For example, the size, shape, color, contrast, focus, and brightness of the digital image can be manipulated to be compatible with a particular use of the mat board. In a further embodiment, the method can include sizing the digital image to be approximately equal in size and shape to a border region of the mat board positioned between an edge of the mat board and an interior region inward from the edge that is open or is configured to be open to allow visual access to the selected item when the selected item is placed behind the mat board.

The invention is also directed to a mat board for framing an image. In one embodiment, the mat board includes a body having a rearward-facing surface and a forward-facing surface facing opposite the rearward-facing surface. The forward-facing surface is separated from the rearward-facing surface by a distance of from about 0.040 inch to about 0.100 inch. The mat board further includes an at least partially non-porous print receiving medium at the forward-facing surface configured to receive ink from an ink jet printer and absorb at least a portion of the ink. A generally non-porous medium is positioned at the rearward-facing surface to at least restrict moisture from passing into the mat board body through the rearward-facing surface. The at least partially non-porous print receiving medium can include a hydrophilic binder polymer, a cross-linked polyvinyl alcohol, a polymeric binder, and insolublized hydrophilic polymer, and/or water soluble latex polymer.

BRIEF DESCRIPTION OF THE DRAWINGS

In the drawings, identical reference numbers refer to identical or substantially similar elements or steps. To easily identify the discussion of any particular element, the most significant digit or digits in a reference number refer to the figure number in which that element is first introduced (e.g, element 304 is first introduced and discussed with respect to FIG. 3). The headings provided herein are for convenience only, and do not affect the scope or meaning of the claimed invention.

FIGS. 5A–5K together illustrate a display description corresponding to the process outlined in FIG. 4.

DETAILED DESCRIPTION

Aspects of the invention are directed to an automated system for printing images directly on a mat board. One embodiment of the invention is particularly useful for printing on mat boards used in the framing industry to frame pictures and other art media. Under this embodiment, a digital image having a size scaled to the size of the mat board is provided on a computer-readable medium. The digital image is transmitted to a computer printer coupled to the computer-readable medium and the digital image is printed directly on to the mat board with the computer printer while the mat board is engaged with the computer printer. The image can include a background texture and color, French lines, clip-art, and/or text or other features. The image can be sized and shaped to accommodate mat boards having a variety of openings for viewing the picture or other art medium positioned behind the mat board.

The following description provides specific details for a thorough understanding of, and enabling description for, embodiments of the invention. However, one skilled in the art will understand that the invention may be practiced without these details. In other instances, well-known structures and functions have not been shown or described in detail to avoid unnecessarily obscuring the description of the embodiments of the invention. Further details and descriptions of additional embodiments of the invention are included in a provisional application titled "Method and Apparatus for Printing and Cutting Mat Boards," filed concurrently herewith and incorporated herein in its entirety by reference. In general, alternatives and alternate embodiments described in this application are substantially similar to the previously described embodiments, and common elements and acts or steps are identified by the same reference numbers. Only significant differences in construction or operation are described in detail.

Figure 1A:
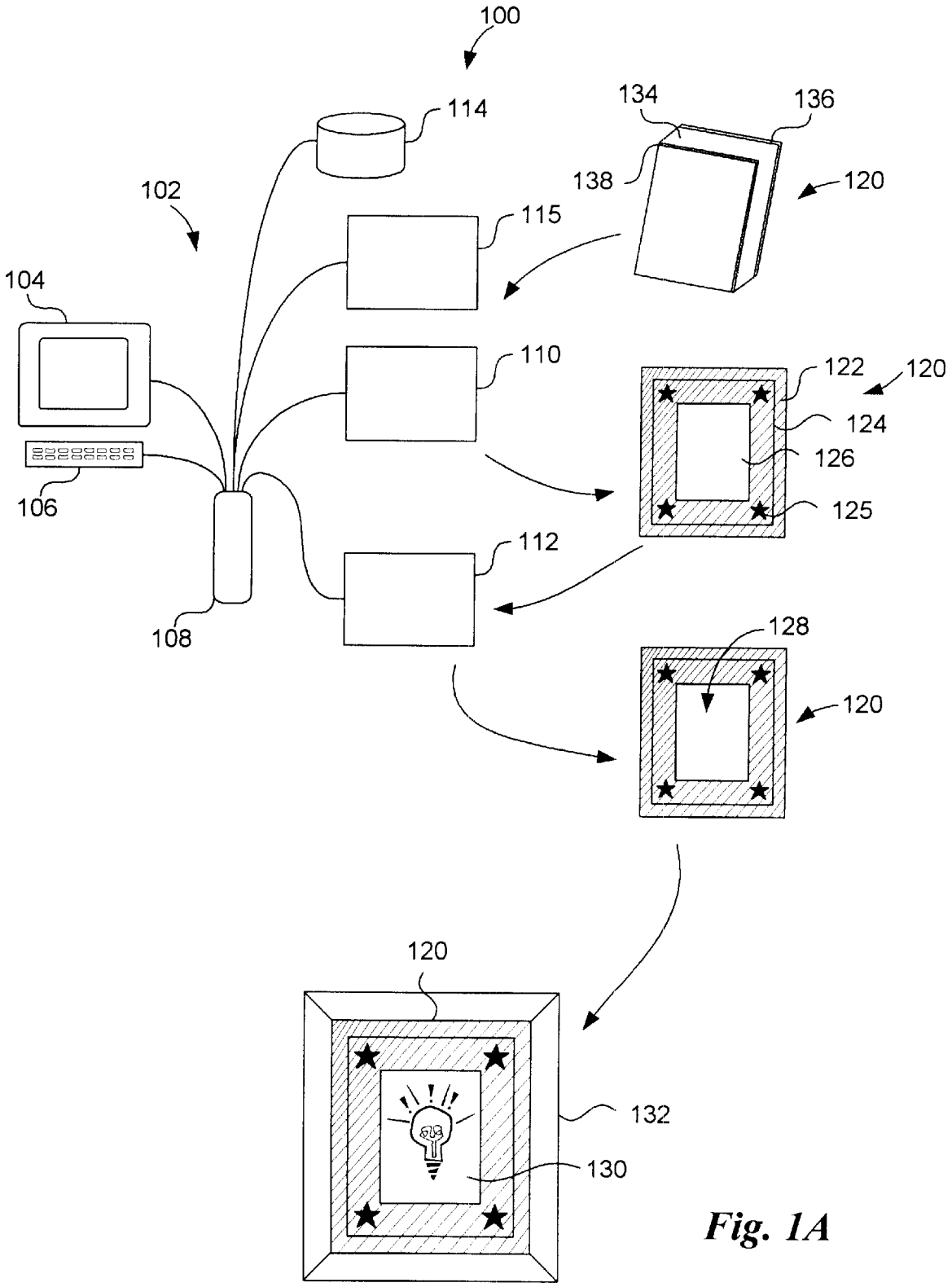
FIG. 1A is a schematic block diagram illustrating components of a computer system for automatically printing on mat boards.

FIG. 1A and the following discussion provide a brief, general description of a suitable computing environment in which the invention can be implemented. Although not required, the embodiments of the invention will be described in the general context of computer-executable instructions on computer-readable media, for example, routines executed by a general-purpose computer, such as a personal computer. Those skilled in the relevant art will appreciate that the invention can be practiced with other computer system configurations, including Internet appliances, hand-held devices, cellular phones, multiprocessor systems, multiprocessor-based or programmable consumer electronics, networked PCs, minicomputers, main-frame computers, and the like. The invention can be embodied in a specific-purpose computer or data processor that is specifically programmed, configured or constructed to perform one or more of the computer-executable instructions explained in detail below. The invention can also be practiced in distributed computing environments where tasks or modules are performed by remote processing devices, which are linked through a communications network. In a distributed computing environment, program modules or subroutines may be located in both local and remote memory storage devices. In general, while hardware platforms, such as terminals and controllers are described herein, aspects of the invention are equally applicable to nodes on the network having corresponding resource locators to identify such nodes.

Unless described otherwise, the construction and operation of the various blocks shown in FIG. 1A are of conventional design. As a result, such blocks need not be described in further detail herein, as they will be readily understood by those skilled in the relevant art.

Referring to FIG. 1A, an embodiment of a mat board processing system 100 includes a computer 102 having a monitor 104, a keyboard 106 and a processor 108. The computer 102 can be coupled to a database 114 stored on a computer-readable medium, with the database storing information such as image files for printing on a mat board with the database. Alternatively, the information can be stored in any other accessible location, such as memory of the processor 108 or on a transportable computer-readable medium (not shown). In either embodiment, the computer 102 can be coupled to a scanner 115 for providing computer-readable images from hardcopy originals. Alternatively, the computer-readable images can be generated by other means, such as by the computer 102 itself. In either embodiment, the image can be a digital image (such as a bitmapped image) and users can modify selected characteristics of the image, such as the color, texture, size, shape and pattern of the image before printing the image on a mat board.

In one embodiment, the computer 102 is coupled to a printer 110 and a mat board cutting apparatus 112. A blank mat board 120 is supplied to the printer 110 and the computer 102 transfers the digital image to the printer 110. The computer 102 also transmits a print signal to the printer, causing the digital image to be printed directly onto the mat board 120. The printed image can include a colored and/or textured background pattern 122, French lines 124, text and/or clip-art 125 or other features. In one embodiment, the printed image does not extend to an interior portion 126 of the mat board, which is removed to provide visual access to the picture placed behind the mat board. Alternatively, the printed image does not extend to the outer edges of the mat board, for example, when this region is covered by a picture frame. In still another embodiment, the printed image can cover the entire surface of the mat board, or can extend slightly into the interior portion 126 to account for slight misalignments during the subsequent cutting process. For example, the image can extend 0.25 inch into the interior portion 126. When an external periphery of the mat board 120 is trimmed, the printed image can extend slightly (for example, 0.25 inch) into the trimmed region. An advantage of not printing on the entire mat board 120 is that this can reduce the time and ink required to print the image.

In one embodiment, the mat board 120 is placed in a cutting apparatus 112 and, upon instructions from the computer 102, the cutting apparatus 112 cuts out the interior portion 126 to leave an aperture 128 in the mat board. The cutting apparatus can also trim the external periphery of the mat board 120 to size. Alternatively, the mat board 120 can be cut prior to printing. In either embodiment, the mat board 120 is then mounted together with a picture 130 (or other art object) and a frame 132 to provide a final framed product.

Figure 1B:
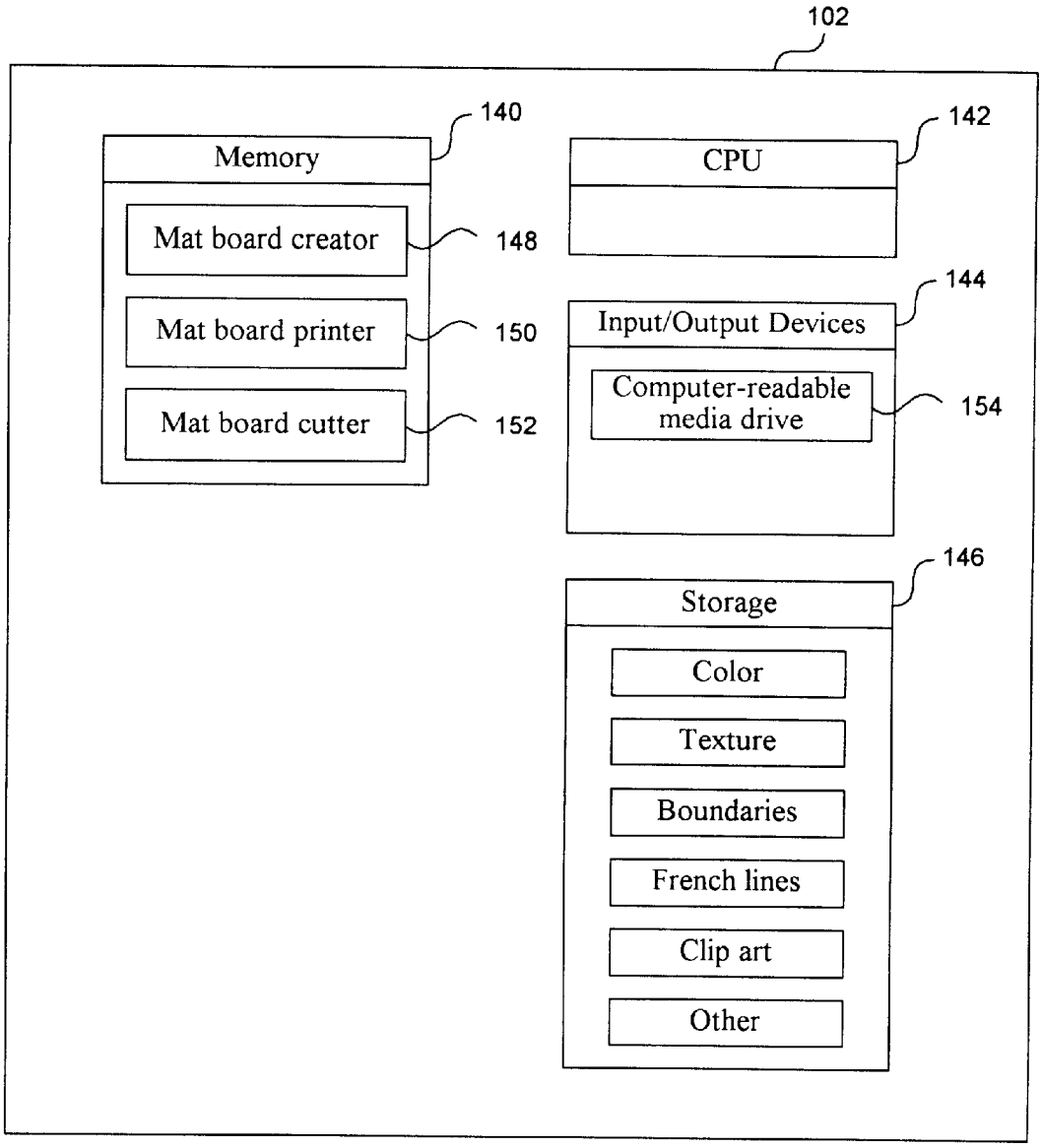
FIG. 1B is a schematic block diagram illustrating in further detail components of a computer system for automatically printing on mat boards.

FIG. 1B is a schematic block diagram illustrating in further detail components of a computer 102 or computer system for automatically printing on mat boards. In one embodiment, the computer 102 can include a memory 140, a CPU 142, input/output devices 144 and a storage device 146. The memory 140 can include software or other computer instructions for implementing a method in accordance with an embodiment of the invention. For example, the software can include a mat board creator 148, for creating and/or manipulating an image for printing on the mat board 120, a mat board printer 150 for printing the image on the mat board 120 using the computer printer 110, and a mat board cutter 152 for cutting the mat board 120 to a specified size.

The input/output devices 144 can include devices such as a computer-readable media drive 154. Accordingly, the input/output devices 144 can read computer-readable media having the software for the mat board creator 148, the mat board printer 150 and/or the mat board cutter 152. The software can also be accessible from the memory 140, as described above. The input/output devices 144 can also read media having images or portions of images for printing on the mat board 120.

The storage device 146 can include file storage for such features as the color, texture, boundaries, French lines and/or clip art of the image printed on the mat board 120. Alternatively, the storage device 146 can include files (or other storage structures) for the above or other features. In either embodiment, the features are accessible via the storage device 146 for printing and/or manipulating.

Figure 2:
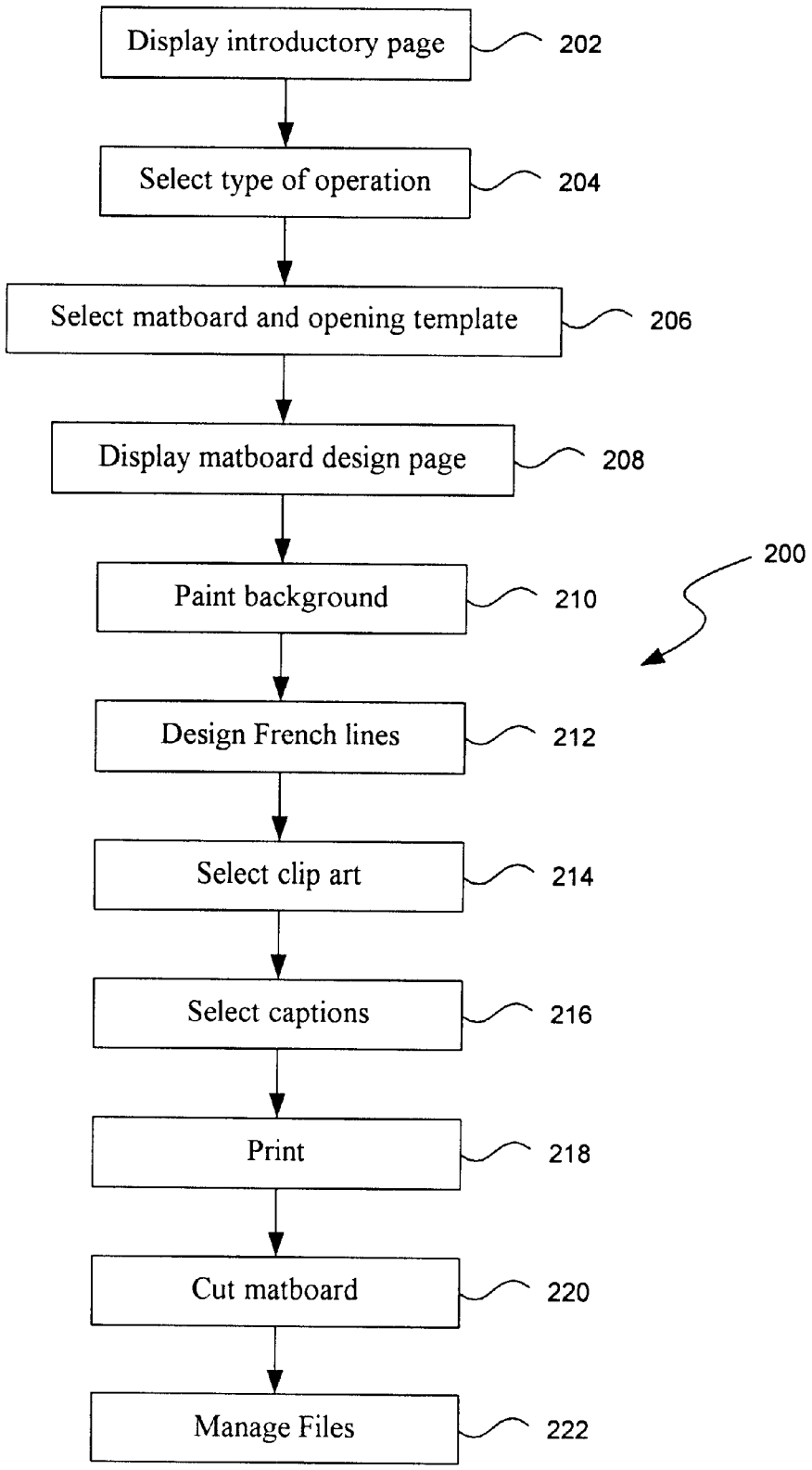
FIG. 2 is a flow diagram of a representative implementation of a printing process performed by the system of FIG. 1 in accordance with an embodiment of the invention.

FIG. 2 is a top-level flow diagram of a representative implementation of a printing and cutting process 200 performed by the components described above with reference to FIGS. 1A and 1B in accordance with an embodiment of the invention. To illustrate the processes performed by the components, each process is described as a single routine implemented on a computer. One skilled in the relevant art will appreciate that each of these processes will typically be implemented as several separate routines or subroutines, or may be combined in larger routines or programs. Many of the processes are described in greater detail with reference to more detailed flow diagrams shown in FIGS. 4, 6, 8, 10, 12, and 14. Many of these processes are also depicted or partially depicted on a display description (such as a page of a computer display) shown in FIGS. 3, 5A–K, 7A–C, 9A–C, 11A–B, 13, and 15A–E. Accordingly, the following discussion refers generally to the process steps shown in FIG. 2 and more specifically to the process steps and display descriptions shown in FIG. 3–15E.

Beginning with step 202, the computer 102 displays an introductory page that includes a number of mat board designing, printing, and/or cutting operations available to the user. In step 204, the user selects the type of operation to be performed, such as whether the mat board design is to be created or read from an existing file. In step 206, the user selects a desired mat board size, and the desired shape, orientation and number of openings to be made in the mat board. The computer 102 displays a mat board design page in step 208 and the user instructs the computer 102 to "paint" an image of the background of the mat board in step 210. The user can add French lines in step 212, clip-art in step 214 and captions in step 216, all via the computer 102. The computer 102 then transmits the completed image and a print instruction to the printer 110 (step 218) to print the image on the mat board 120. In step 220, the computer 102 transmits a signal to the cutting apparatus 112 to cut the mat board 120. In step 222, the user manipulates the computer 102 to manage the files created and used during the foregoing processes.

Figure 3:
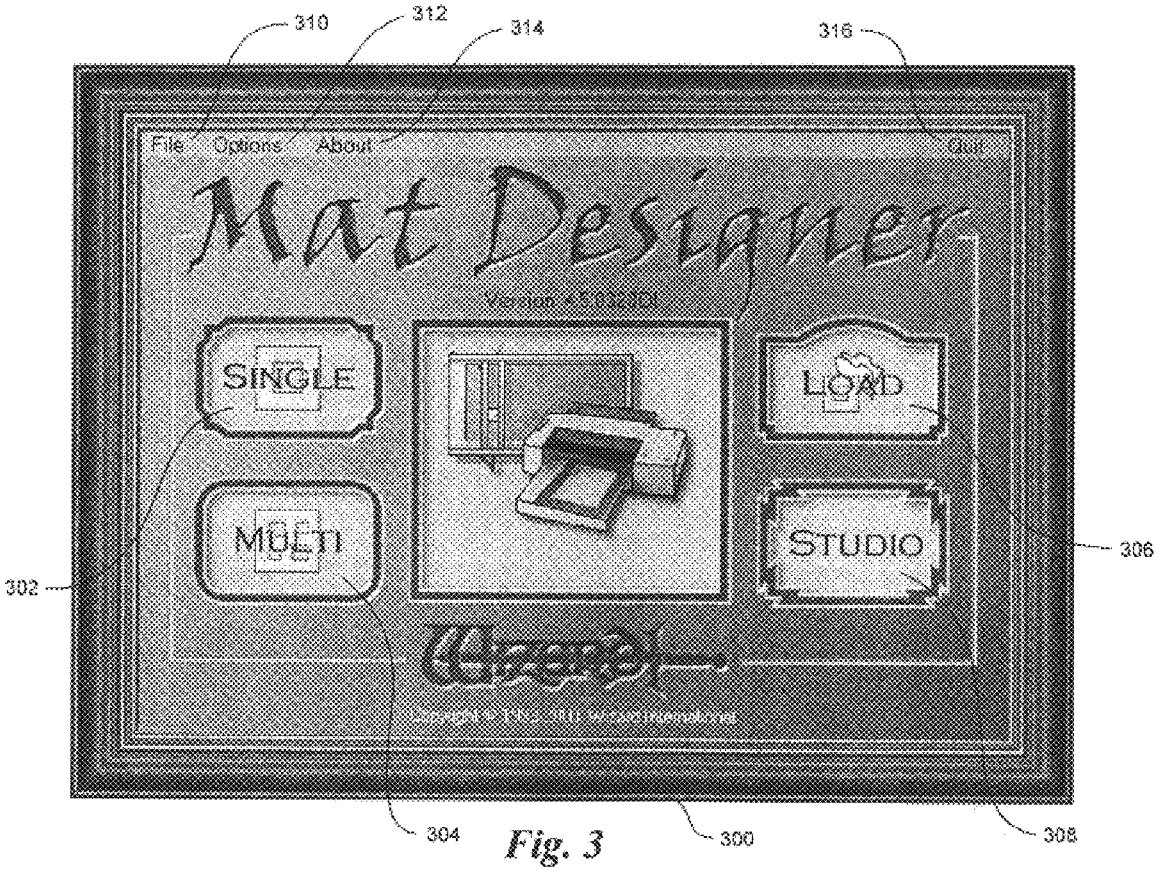
FIG. 3 illustrates a display description for initiating a mat board printing and cutting process.

FIG. 3 shows an embodiment of an introductory page 300 displayed on the computer 102 in step 202. The introductory page 300 can include icons for selecting process steps, for example, a single opening icon 302 for printing a mat board with a single opening, a multi-opening icon 304 for printing a mat board having multiple openings, a load icon 306 for loading previously saved mat designs from a disk or other computer-readable medium, and a studio icon 308 for visualizing an existing mat board design. The user can click on a file button 310 to print a stored image without further manipulation. An options button 312 can be used to set options, such as system defaults, and clicking on an about button 314 displays information about the system. The user clicks on a quit button 316 to exit the program.

Figure 4:
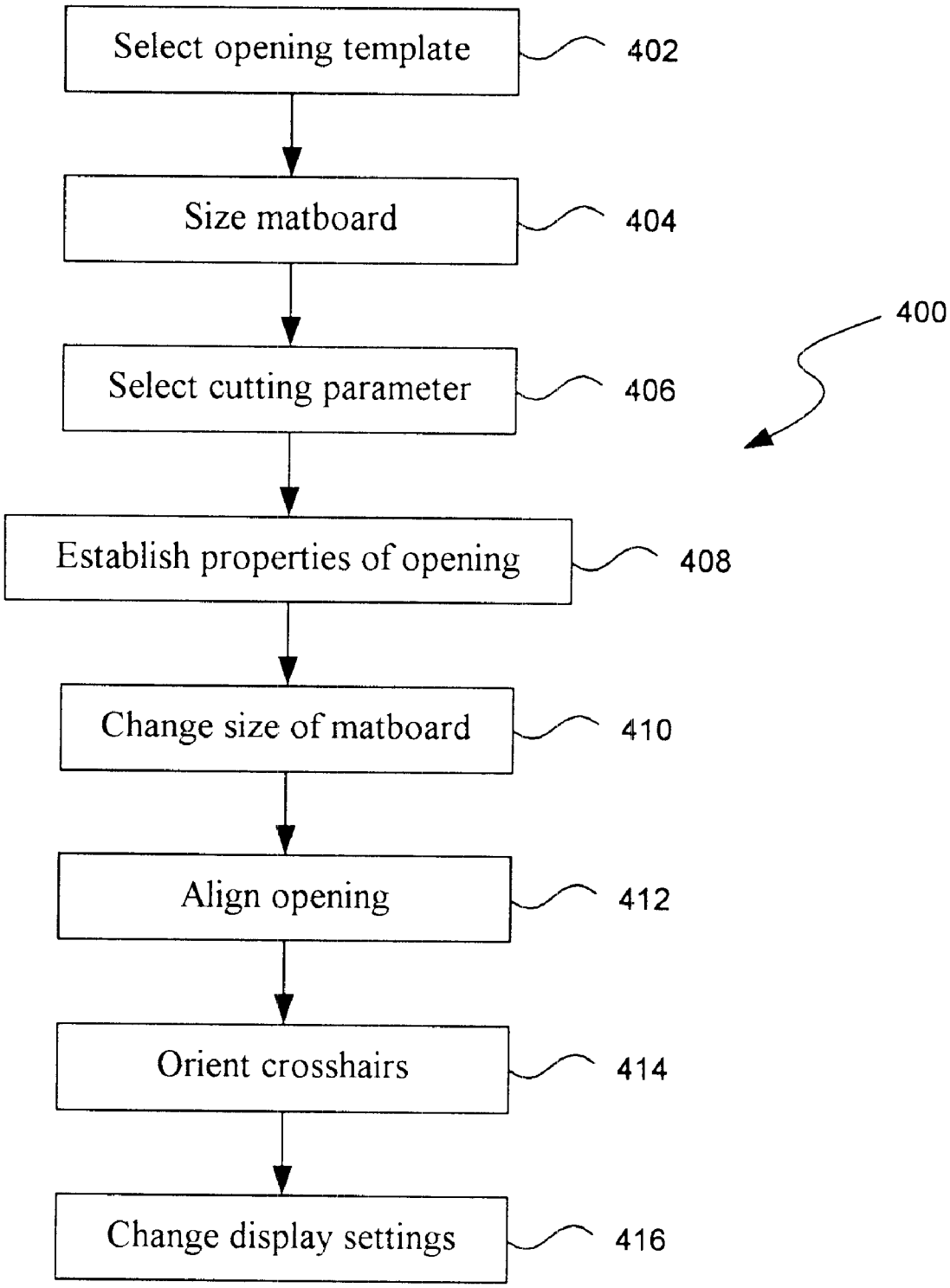
FIG. 4 is a flow diagram of a representative implementation of a layout process performed by the system of FIG. 1 in accordance with an embodiment of the invention.

The user creates a new mat design or changes an existing mat design by clicking on one of the icons shown in FIG. 3 and following a layout process 400 (shown in a flow diagram in FIG. 4). FIGS. 5A–5K depict a corresponding series of display descriptions corresponding to the steps of the process 400. For example, if the user selects the single opening icon 302, the user is presented with a template page 500 having a plurality of numbered template lists 502. Each list 502 may be clicked on to display a series of opening templates 504. The user selects one of the opening templates 504 (for example, the oval opening) in step 402 and is presented with a sizing page 506 (shown in FIG. 5B). In step 404, the user can size the outer boundaries of the mat board by entering numerical values in a mat width field 508 and a mat height field 510. Alternatively, the user can access a list of standard mat dimensions 514 or a list of recently used mat dimensions 516. In either embodiment, the user can increment the dimensions with the "+" and "−" buttons adjacent each field. Once the mat width and mat height are established, the user can "swap" these dimensions using the swap button 514. In step 406, the user can establish whether or not the mat width and mat height are less than the overall dimensions of the mat board material from which the desired mat board is to be cut. If the desired mat width and mat height are less than the height and width of the board from which the mat is to be cut, the user clicks on a "cut outside" box 534 (step 406) for trimming excess material around the outside of the defined outer boundaries of the mat board.

In step 408, the user establishes the properties of the opening in the mat board. For example, the user can position the opening relative to the edges of the mat board by inputting values in a bottom border field 518, a top border field 520 and a side border field 522. The user can also enter values in an opening width field 524 and an opening height field 526 to establish the height and width of the opening. As described above, the user can click on a "recent" button 530 to recall recent opening dimensions and can click on a "swap" button 528 to swap the opening height and the opening width.

The user can specify the number of layers or "reveals" of mat board to be created by entering a value in a layers field 532. Each layer is printed on a separate mat board 120, and the mat boards 120 are then stacked one behind the other between the frame 132 (FIG. 1A) and the picture 130 (FIG. 1A). Accordingly, each mat board 120 (and, correspondingly, each layer) can have an identically shaped opening, with the opening in the upper mat board slightly larger than the opening in the lower mat board so that a portion of the lower mat board is visible through the opening in the upper mat board. In one embodiment, the process provides two layers for the design by default. By clicking on a reveals field 535, the user can specify the offset between the edges of the openings in adjacent layers. The user can then click on an "Info" tab 536 to input particular information regarding this design and can click on a "Params" tab 538 to access other parameters of the opening, as described below with reference to FIG. 5E.

Figure 5A:
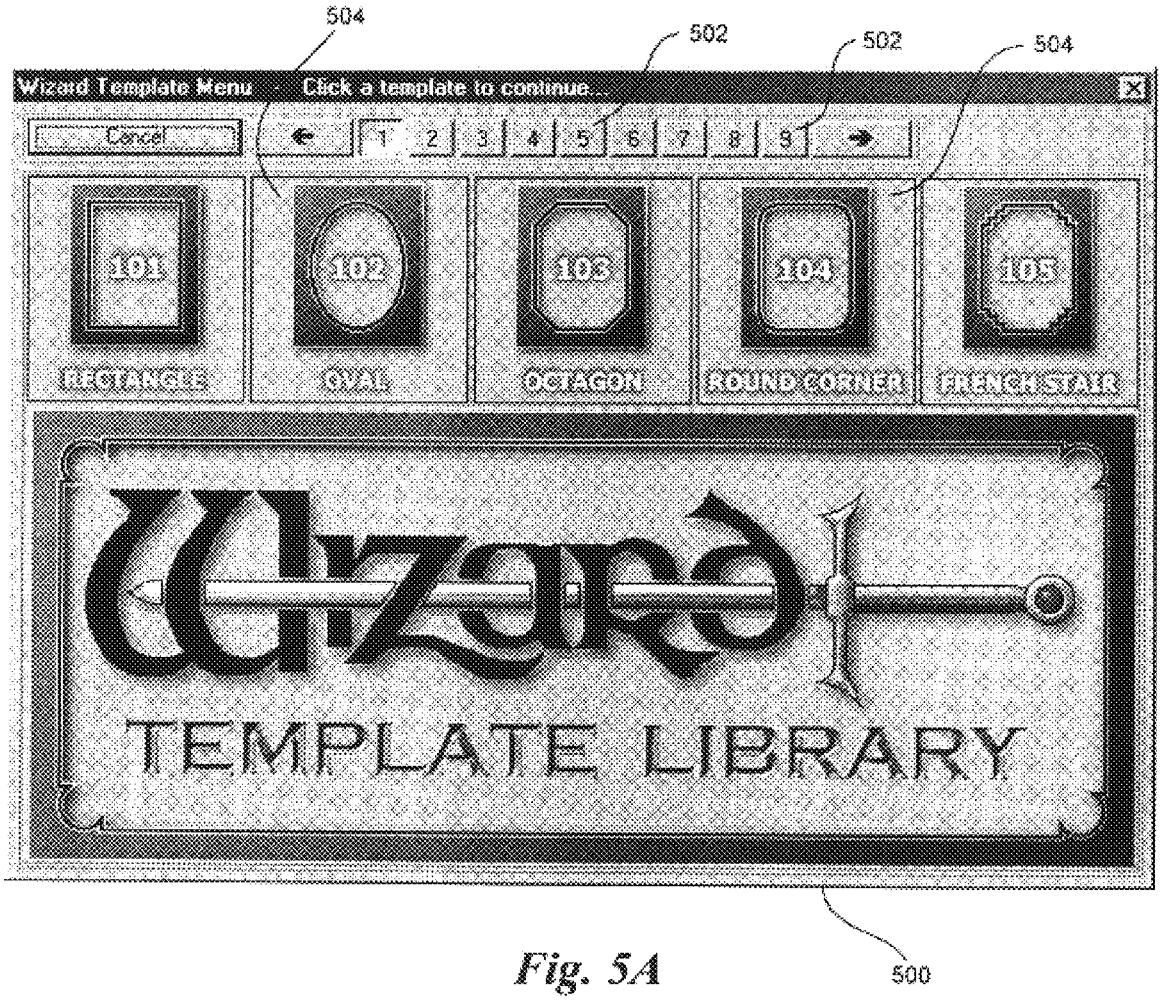
Figure 5B:
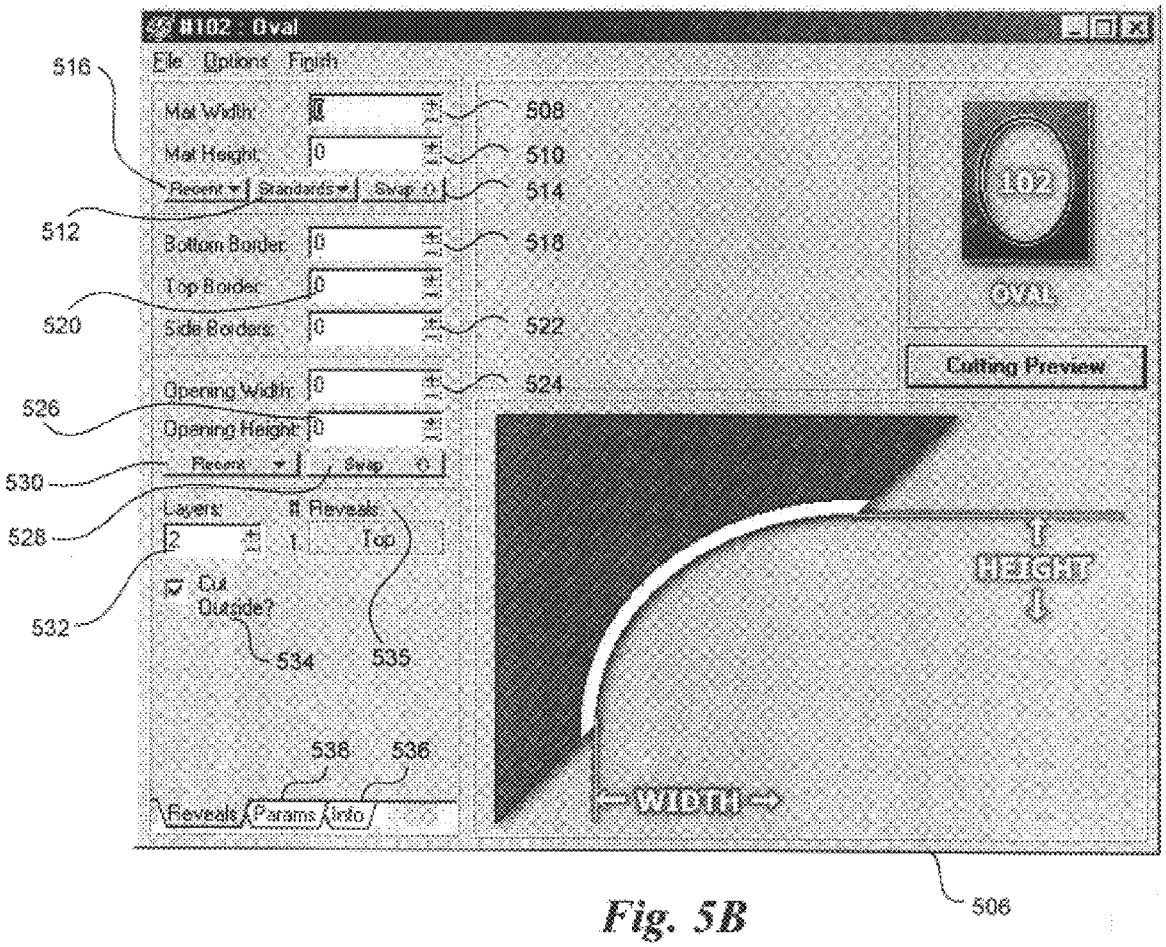
Figure 5C:
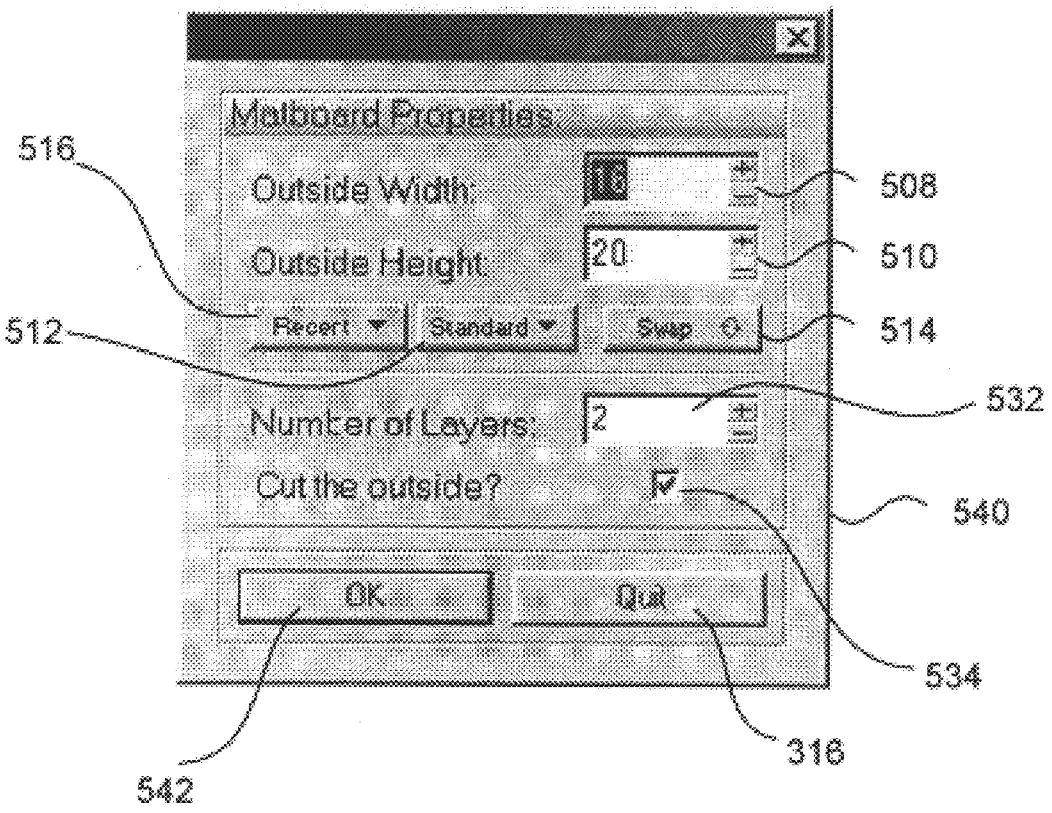
Figure 5D:
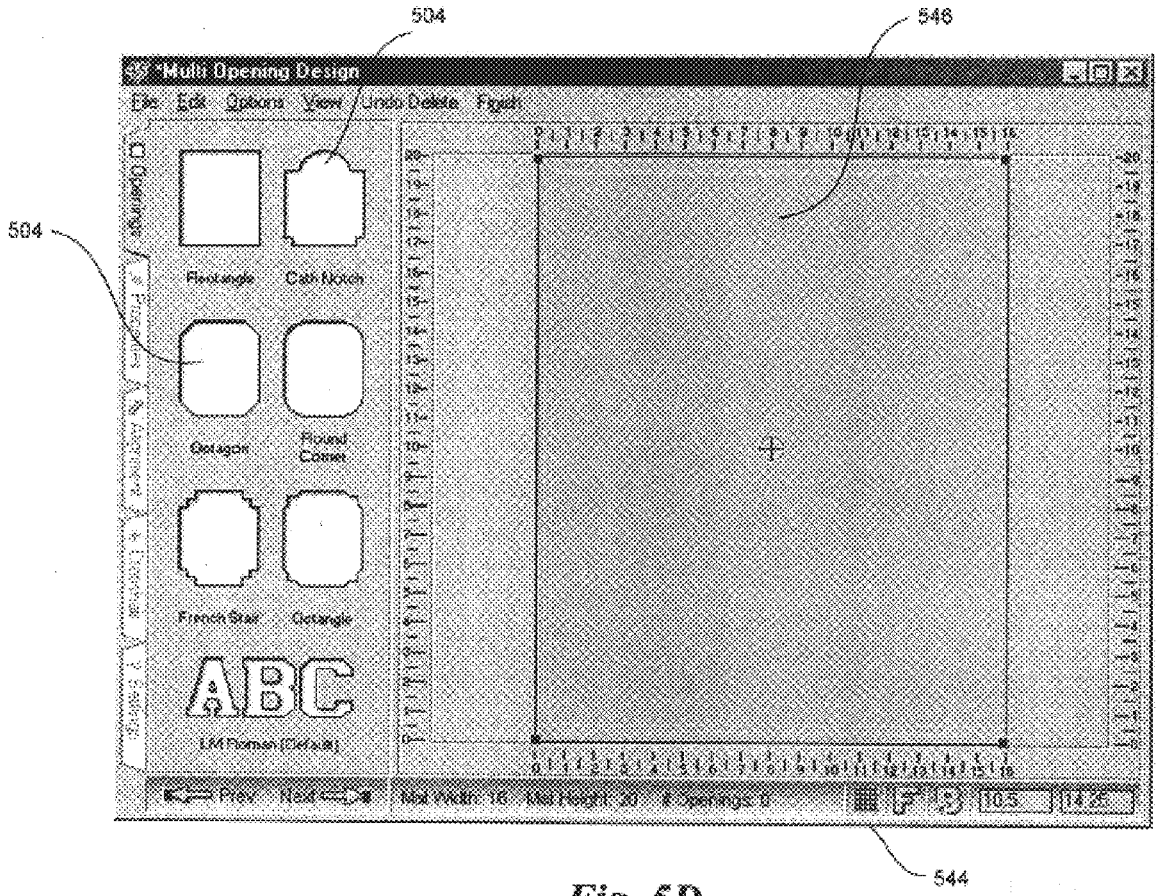
Figure 5E:
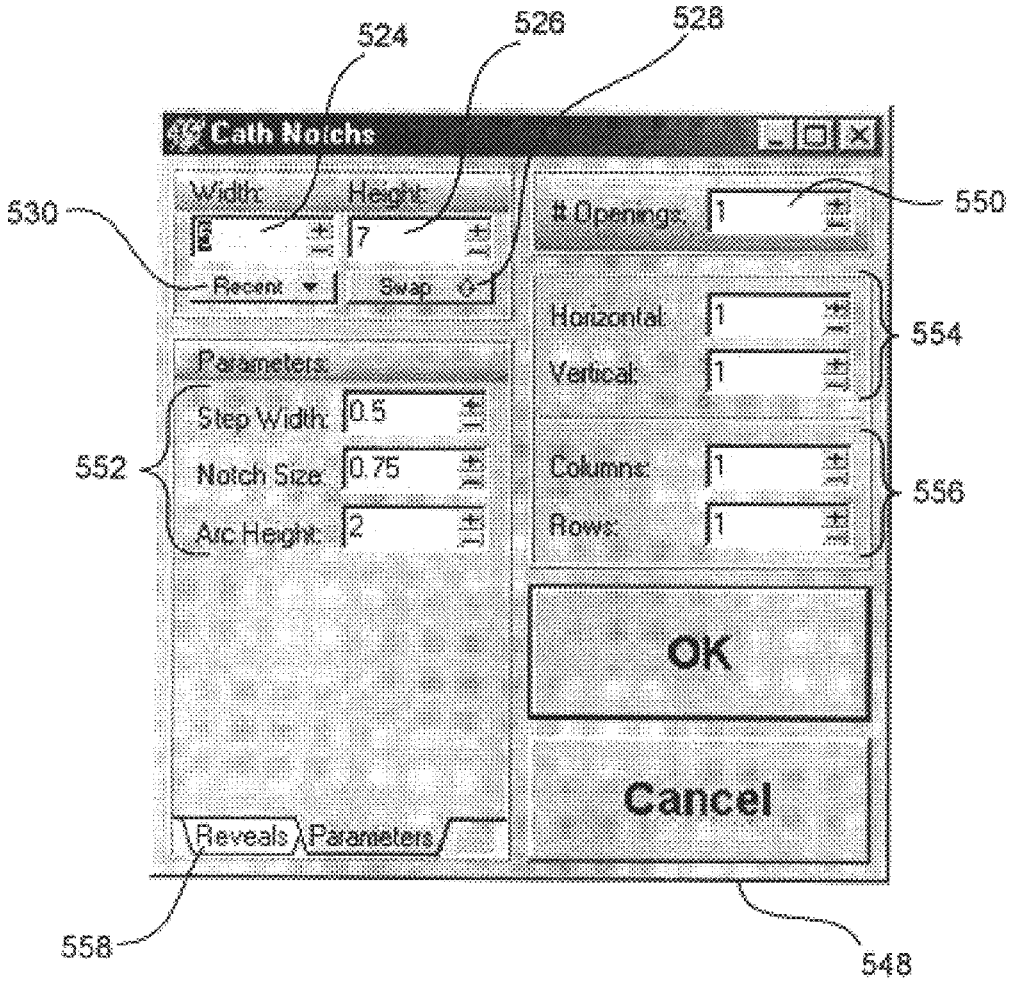

If the user clicks on the multi-opening icon 304, the computer system displays a mat board properties page 540, shown in FIG. 5C. The mat board properties page 540 includes fields generally similar to (and labeled with identical numbers to) the fields described above with reference to FIG. 5B for sizing the mat board. The user can then enter the dimensions by pressing the "OK" button 542 or can quit and return to the design page 300 by clicking on the quit button 316.

To continue the multi-opening design, the user accesses a multi-opening design page 544 (FIG. 5D), which displays a mat board field 546 (illustrating the current configuration of the mat board) adjacent to a series of opening templates 504. More opening templates (such as those available via the menu shown in FIG. 5A) are available by clicking on any of the template labels shown in FIG. 5D. The user can select one or more of the opening templates 504 and drag them to the mat board field 546. In one aspect of this embodiment, the user can double click one of the templates 504 to display an opening properties page 548, shown in FIG. 5E. The properties page 548 includes an openings field 550 that indicates the number of openings selected, and a width field 524, a height field 526, a recent field 530 and a swap field 528 that operate in a manner generally similar to that discussed above with reference to FIG. 5B. The user can adjust other dimensions of the opening (which are specific to the particular opening chosen) by adjusting the values in the parameters field 552.

The horizontal and vertical location of the opening can be adjusted by selecting values for the position field 554 and the user can select whether multiple openings are stacked above each other or side by side by adjusting the numbers in the columns and rows fields 556. The user can also adjust the offset between layers by accessing the reveals tab 558.

Figure 5F:
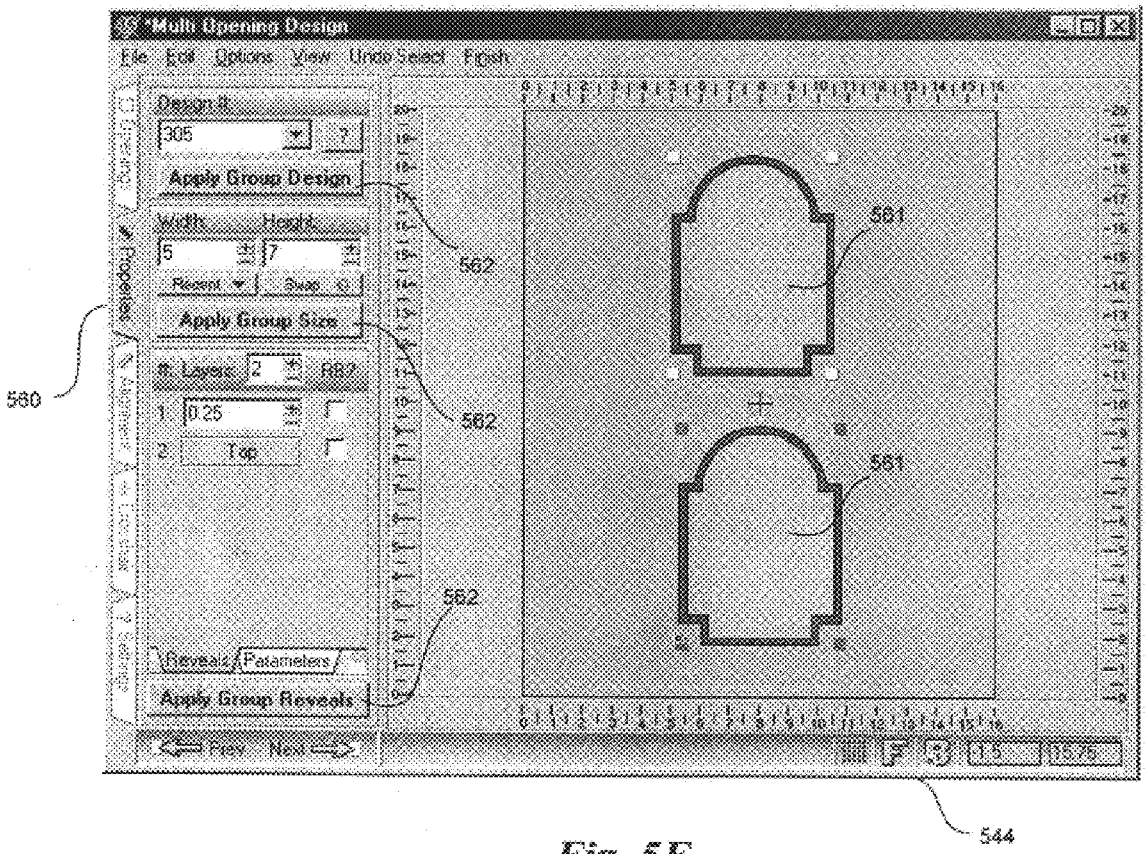
Figure 5G:
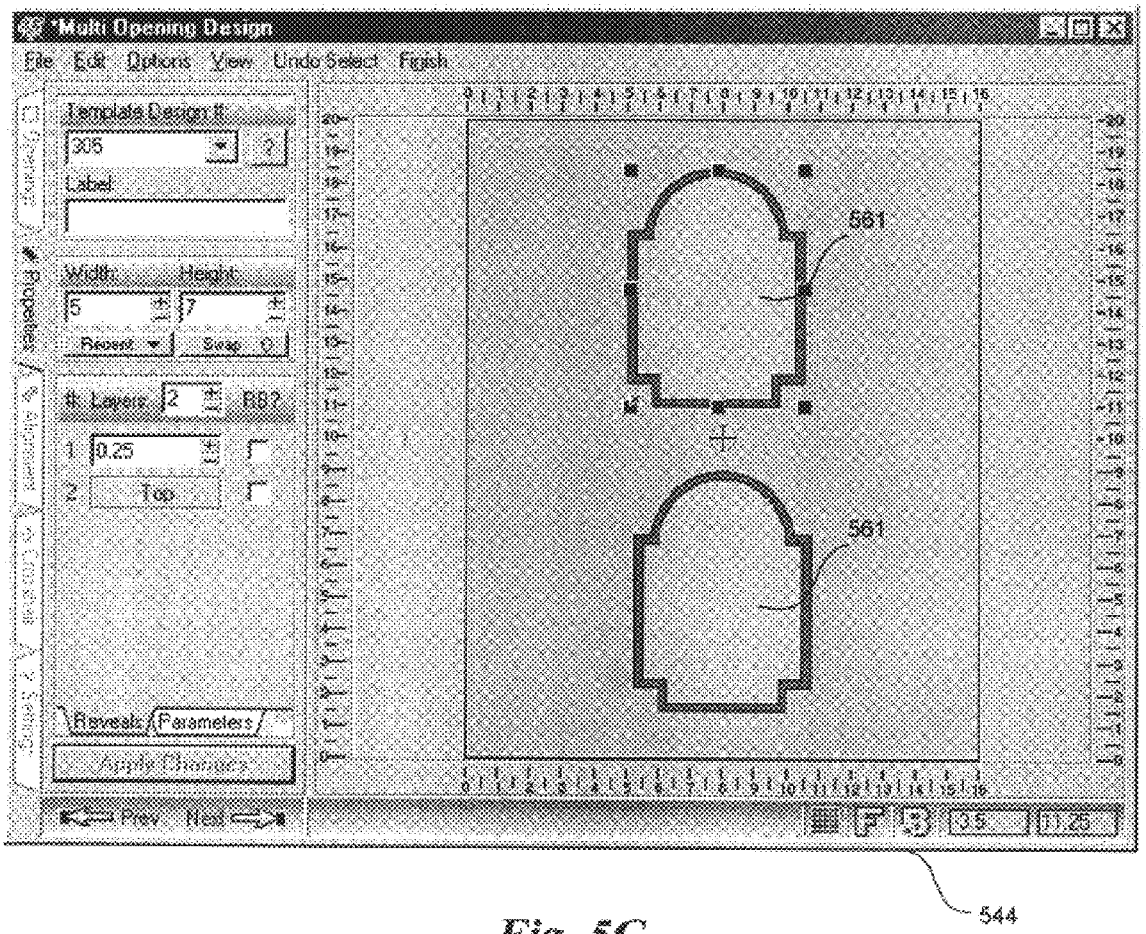

Alternatively, the user can adjust the characteristics described above with reference to FIG. 5E by clicking on the properties tab 560 (as shown in FIG. 5F) to display the properties of scaled openings 561, two of which are shown in the mat board field 546. Changes made to the properties of an opening 561 can be applied to an individual opening by first clicking on that opening. For example, as shown in FIG. 5G, the upper opening 561 has been selected (as indicated by square selection blocks) and the properties accordingly apply only to the upper opening 561. Alternatively, the changes can be applied to all the openings 561 by forming a selection box around all the openings 561 (for example, with the right button of a computer mouse) and applying the changes to the openings 561 using the apply group buttons 562 shown in FIG. 5F.

Figure 5H:
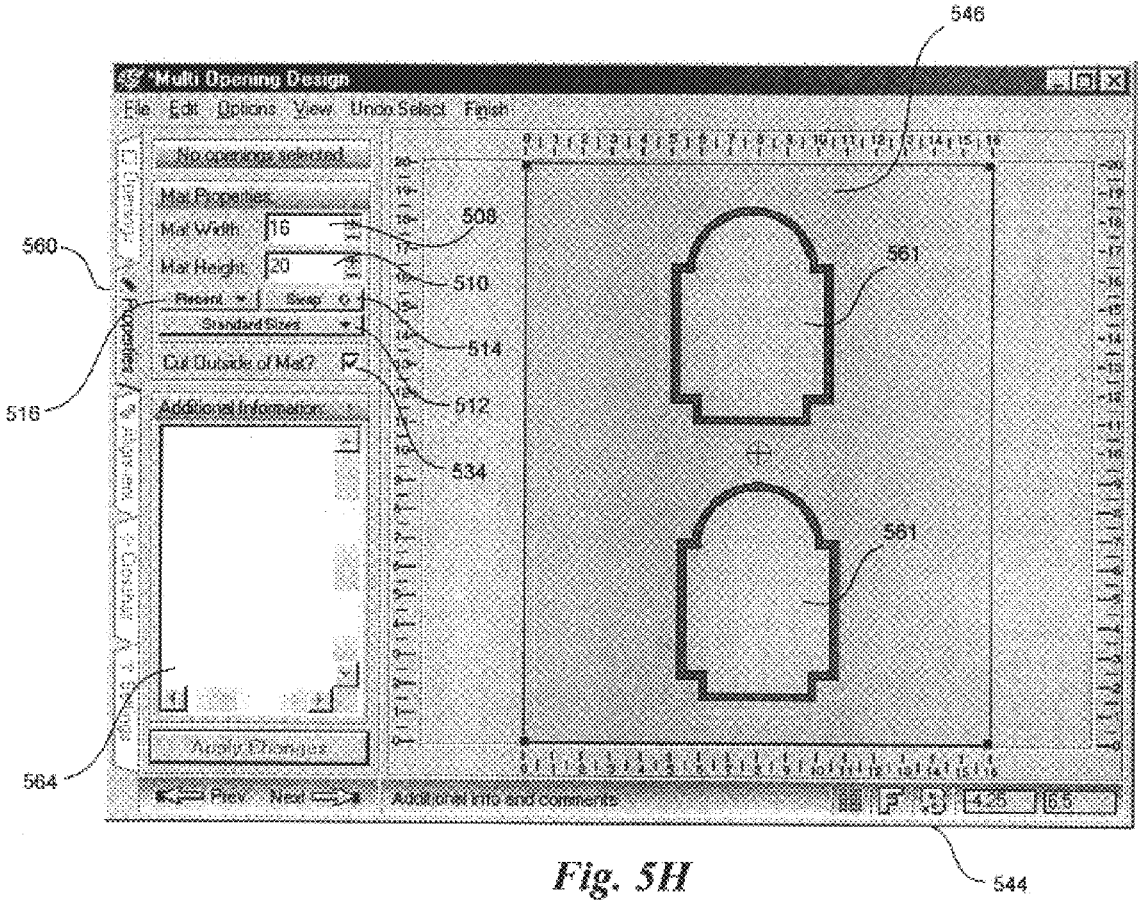
Figure 51:
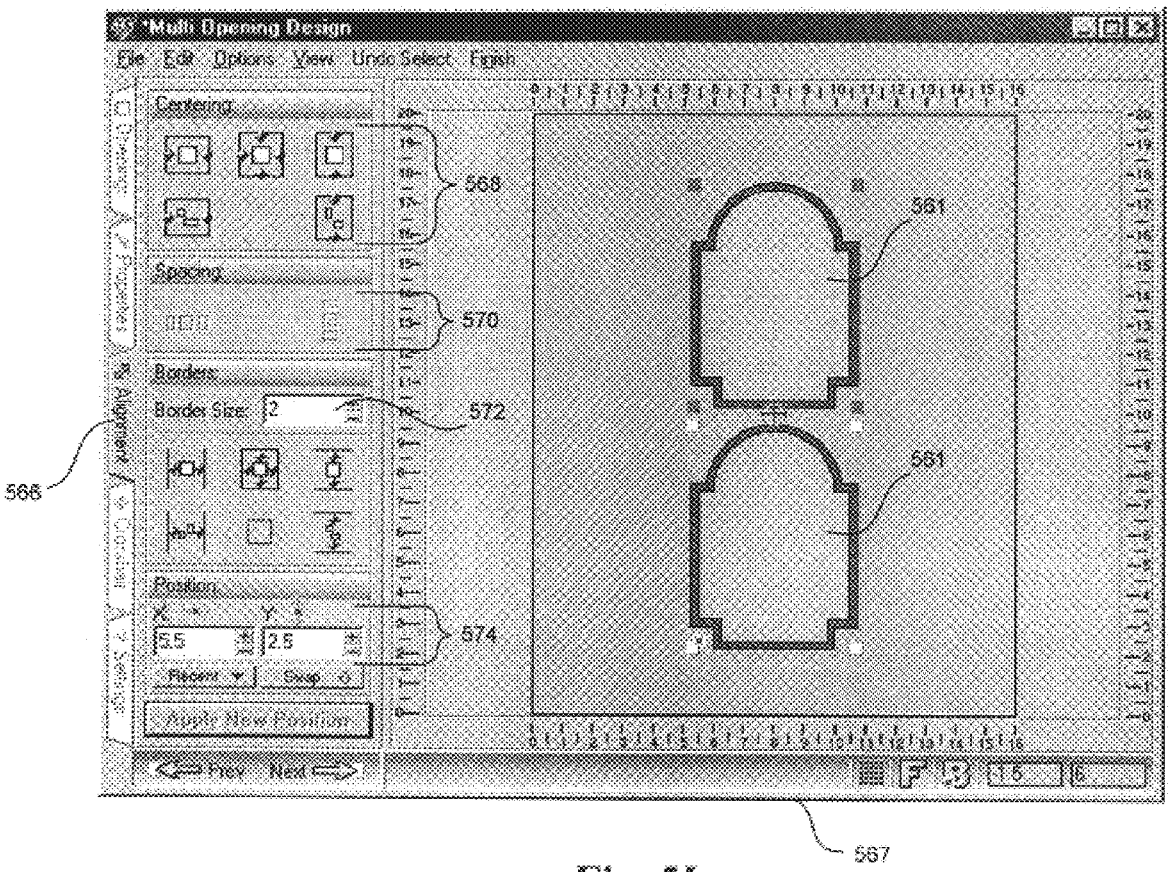

As shown in FIG. 5H, the user can also adjust the properties of the mat board (step 410) by clicking on a region of the mat board field 546 spaced apart from the openings 561. The user can also add additional text information in an additional information field 564. The text information is saved with the mat board file, for example, for identification or other purposes.

In step 412, the user can align the openings 561 by clicking on an alignment tab 566 and accessing an alignment page 567 shown in FIG. 5I. The user can align a plurality of openings 561 simultaneously by forming a selection box around the openings 561, or the user can align each opening 561 individually. In either embodiment, the opening or groups of openings can be centered relative to the edges of the mat board, or relative to each other, by clicking on the appropriate icon 568. When the mat board design includes three or more openings 561, the user can adjust the spacing between adjacent openings 561 by clicking on a spacing icon 570. The size of the border around the openings 561 can be changed by entering the appropriate number in the border size field 572. The position of each opening 561 can also be adjusted by either clicking and dragging that opening or inputting a numerical x or y value in the appropriate position field 574.

Figure 5J:
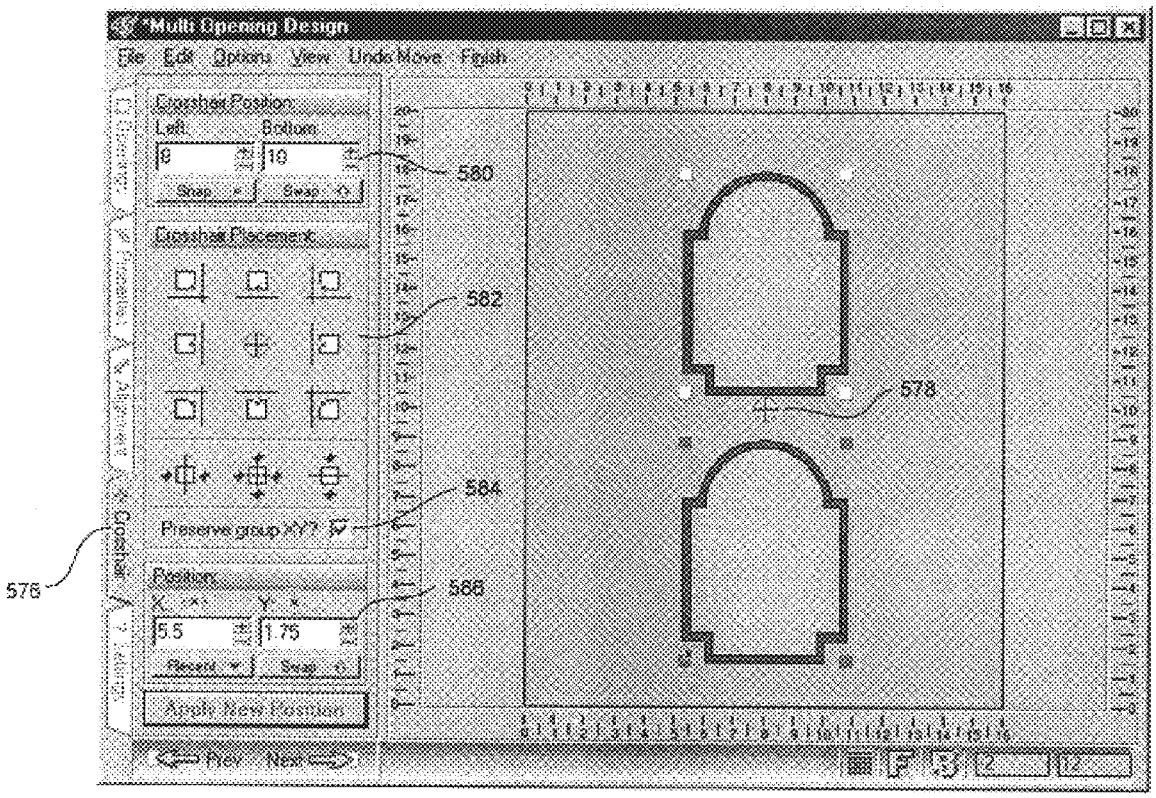

In step 414, the user can orient one or more of the openings 561 relative to a set of cross-hairs by clicking on a cross-hair tab 576 and accessing a cross-hair page 577 shown in FIG. 5J. The user can adjust the position of a cross-hair icon 578 by dragging it with a mouse or by inputting numerical values in the cross-hair position fields 580. Once the cross-hair icon 578 is in the desired position, the user can adjust the location of one or more of the openings 561 relative to the cross-hair icon 578 by clicking on the appropriate cross-hair placement icon 582. By clicking on the "preserve group xy" field 584, the user can maintain the x and y spacing between adjacent openings 561 when the openings 561 are moved as a group. The user can also independently move one or more of the openings 561 by entering the appropriate value in the position fields 586.

Figure 5K:
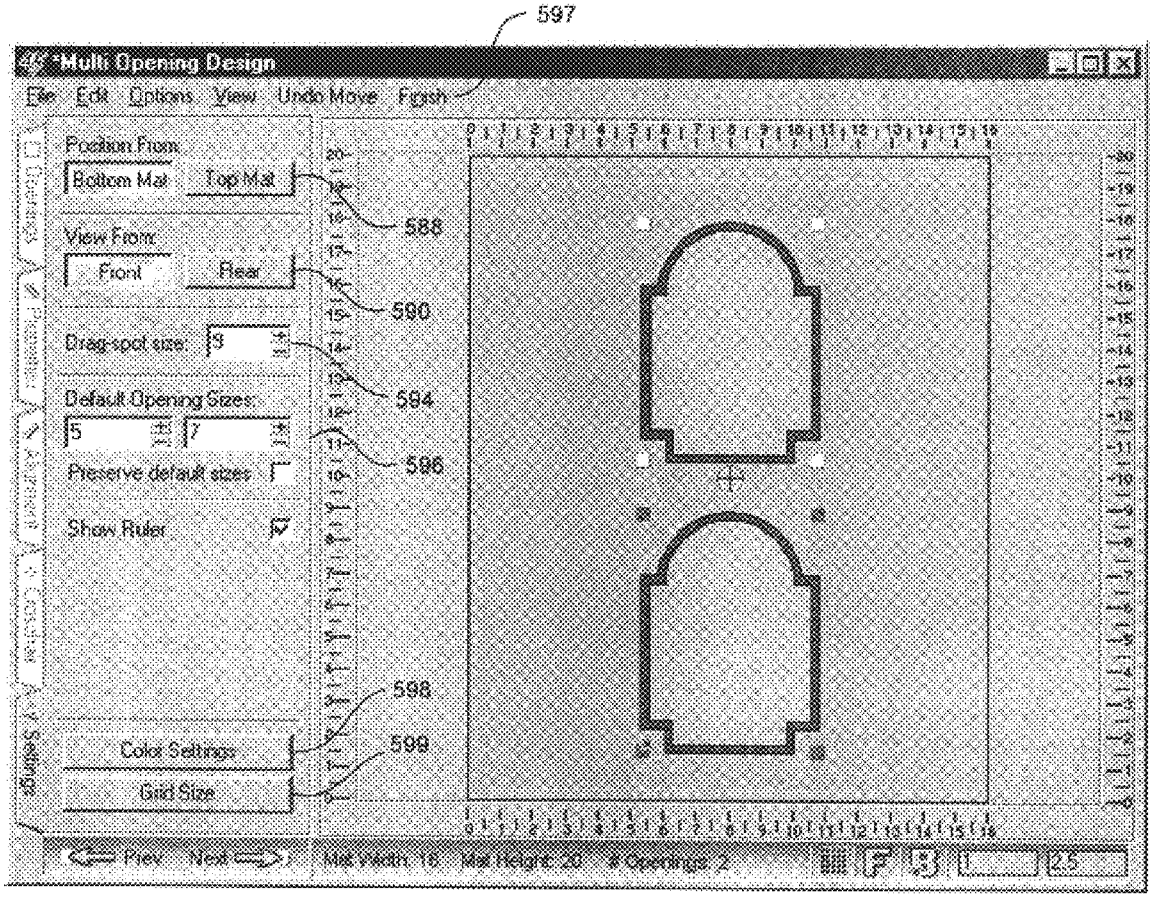
Figure 6:
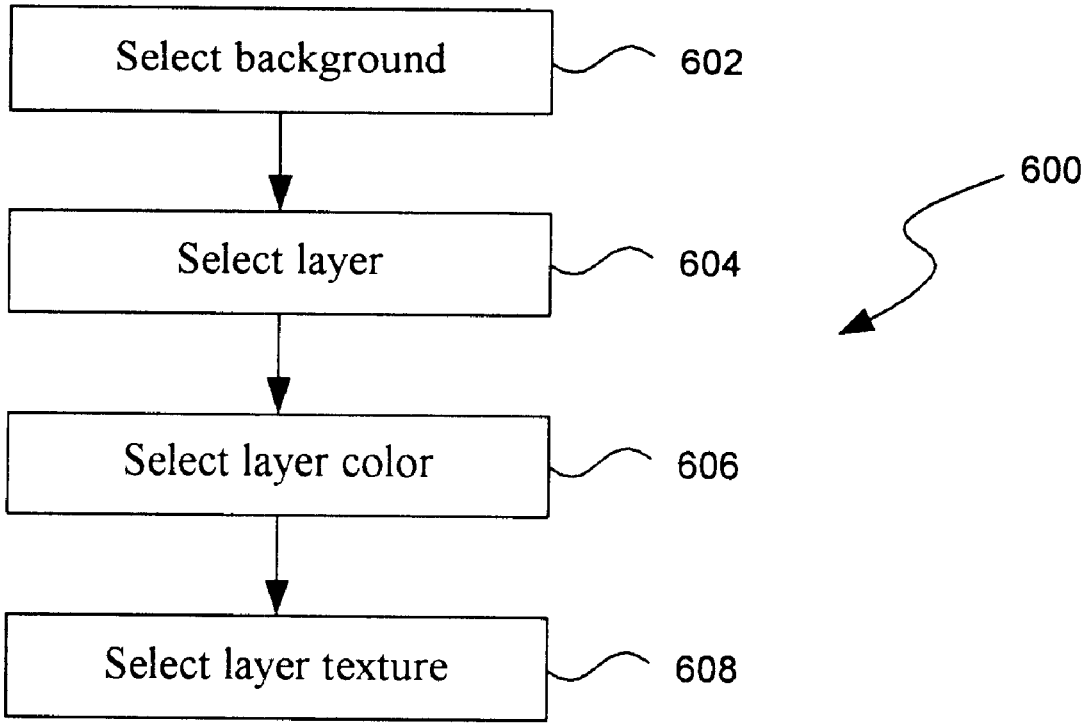
FIG. 6 is a flow diagram of a representative implementation of a coloring and texturing portion of a process performed by the system of FIG. 1 in accordance with an embodiment of the invention.

In step 416, the user can change the display settings, as shown in FIG. 5K. For example, when the mat board design has multiple layers, the user can select whether the dimensions are referenced to the top layer (mat) or the bottom layer (mat) by clicking on the appropriate button in the "position from" field 588, and can select whether the mat is viewed from the front or rear by clicking on the appropriate "view from" field 590. The square selection blocks 592 (indicating which items have been selected) can be changed in size by entering the appropriate value in the drag spot size field 594. The user can also change the default size of the openings 561 by entering the appropriate value in the default opening size field 596. Finally, the user can change the display color and the density of the grid around the borders of the display by clicking on the color setting box 598 and the grid size box 599, respectively. The user can then complete the design of the mat by clicking on the "finish" drop down menu 597 and selecting "paint mat." FIG. 6 is a flow diagram of a representative coloring and texturing process 600 performed by the system described above with reference to FIGS. 1A and 1B in accordance with an embodiment of the invention. In step 602, the user selects the background to be painted by clicking on a background icon 702 of a display page 700, which displays the layers of the mat board design side by side. In the embodiment shown in FIG. 7A, two layers are shown: a lower layer 704*a* having lower openings 561*a* and an upper layer 704*b* having upper openings 561*b* that are slightly larger than the lower openings 561*a*. Accordingly, when the upper layer 704*b* is placed on the lower layer 704*a*, a rim region 706 (outlined in dashed lines in FIG. 7A) around the lower openings 561*a* will be visible through the upper openings 561*b*.

In step 604, the user selects a layer and for each layer, the user can select a color (step 606) by clicking on a load color button 708 and a texture (step 608) by clicking on a load texture button 710. When the user clicks on the load color button 708, a color page 712 (FIG. 7B) appears on the user's screen. The user can select a color from the color display 712 by clicking on a color chip 713, or by entering the row and column value corresponding to a particular chip in fields 714 and 716. Alternatively, the user can blend a color by selecting a mix of red, green and blue and entering numerical values in the appropriate red, green and blue fields 718.

Figure 7A:
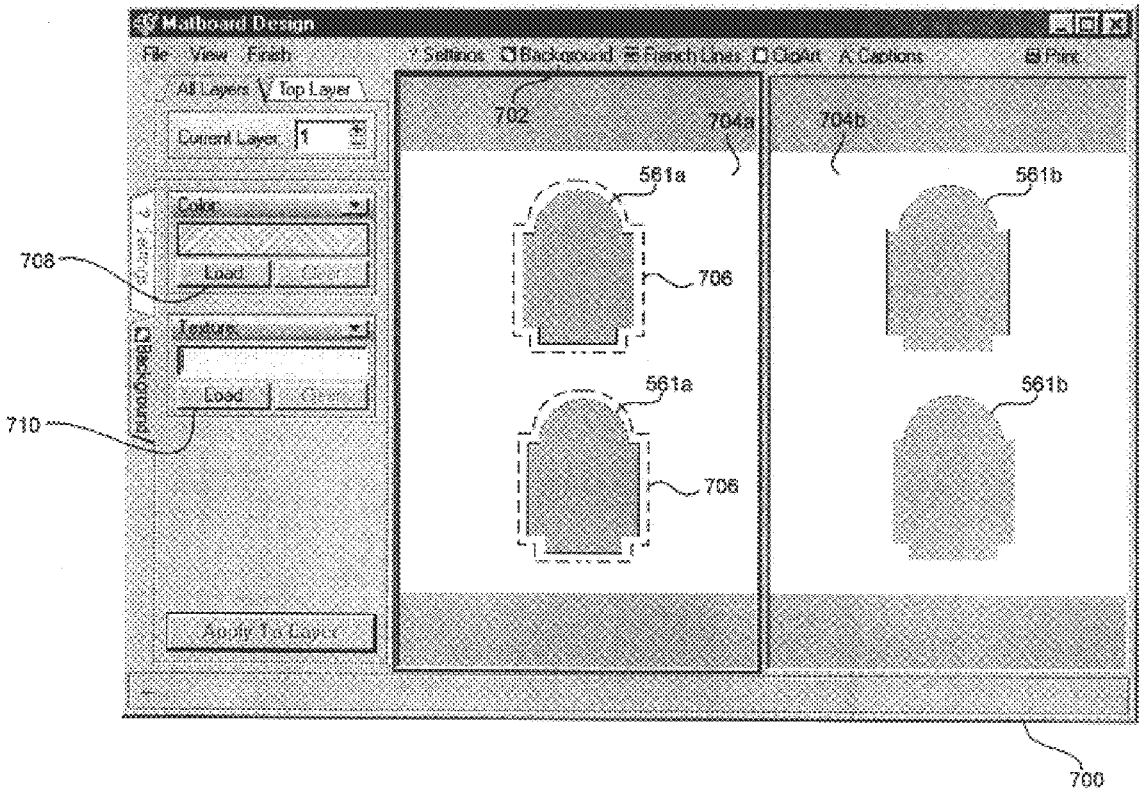
FIGS. 7A–7C together illustrate a display description corresponding to the process outlined in FIG. 6.
Figure 7B:
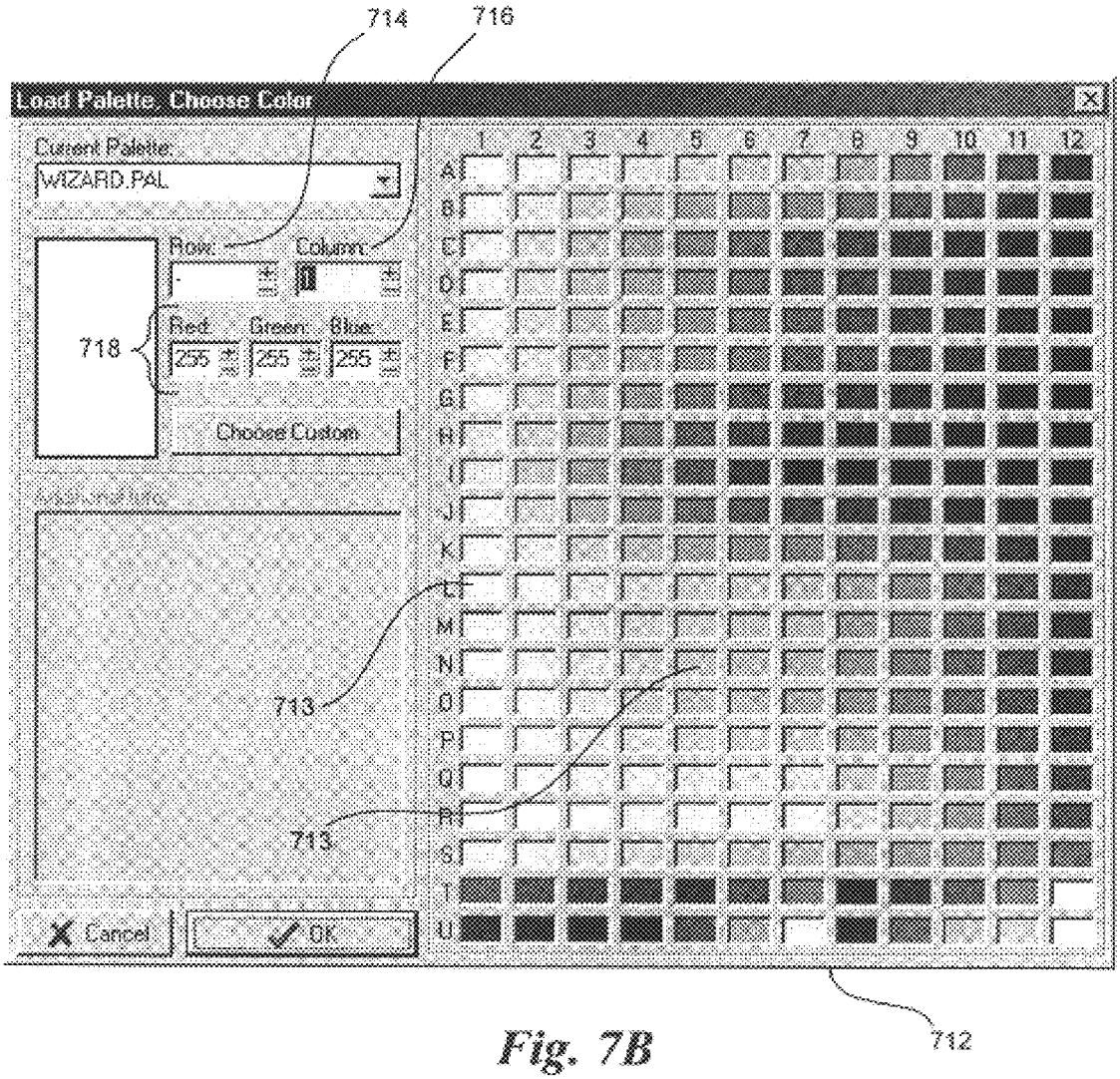
Figure 7C:
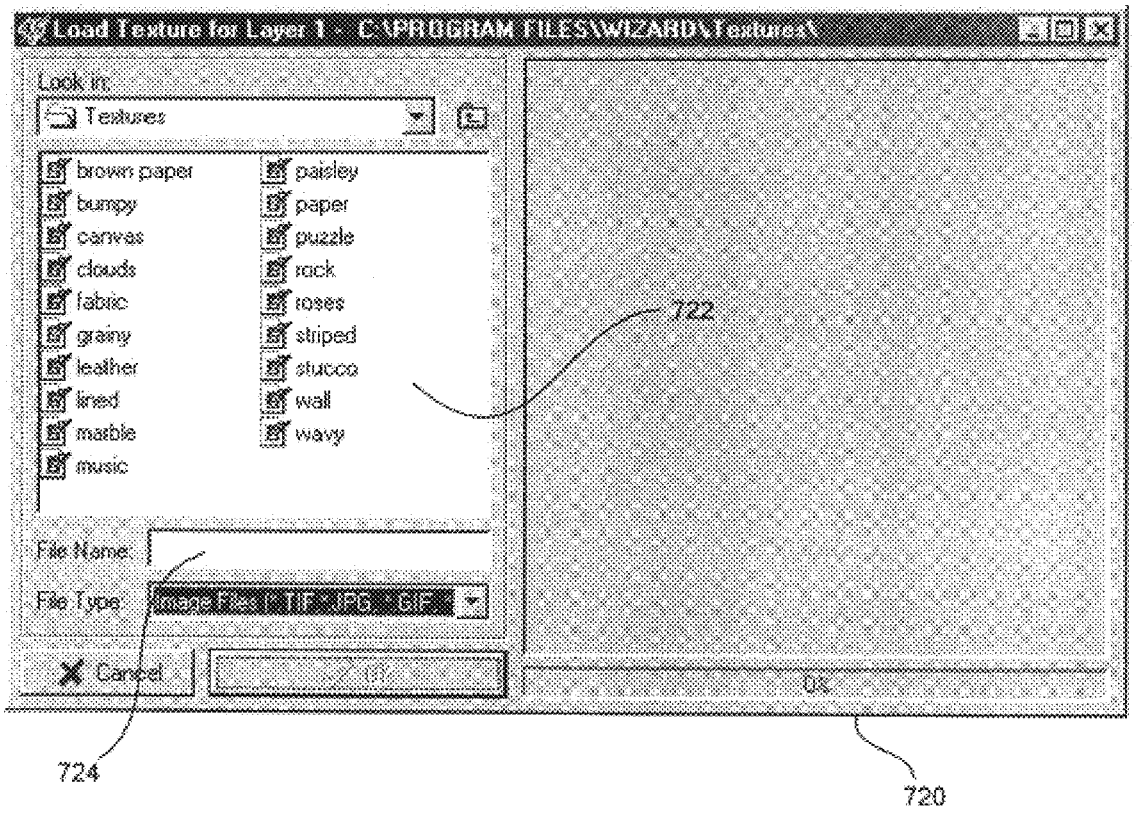

When the user clicks on the load texture button 710, a texture page 720 is displayed (FIG. 7C). As used herein, the term texture refers to a two-dimensional pattern superimposed on the selected color, as opposed to a three-dimensional texture, such as an embossed texture. The user can select from a number of pre-loaded texture files located in a default location (such as the "c-drive" of the computer 102) and listed in a texture field 722. The texture files can be created by scanning an image with the scanner 115 (FIG. 1), or by using design programs, such as PhotoShop, available from Adobe Systems Inc., of Seattle, Wash. In a further aspect of this embodiment, the texture file can include an image of the picture 130 or a portion of the picture 130 mounted beneath the mat board 120. In still a further aspect of this embodiment, the texture file can include a repeating image (or "tile") of the picture 130, a portion of the picture 130 or another picture or image. Alternatively, the user can enter the location of a particular texture file in a file field 724.

In any of the foregoing embodiments described with reference to FIGS. 7A–7C, the selected color and texture are applied to the selected layer by clicking on an apply to layer button 726 (FIG. 7A). In other embodiments, the user can instruct the program to adjust other color and texture related aspects of the image printed on the mat board, such as the brightness, contrast and/or focus of the image.

Figure 8:
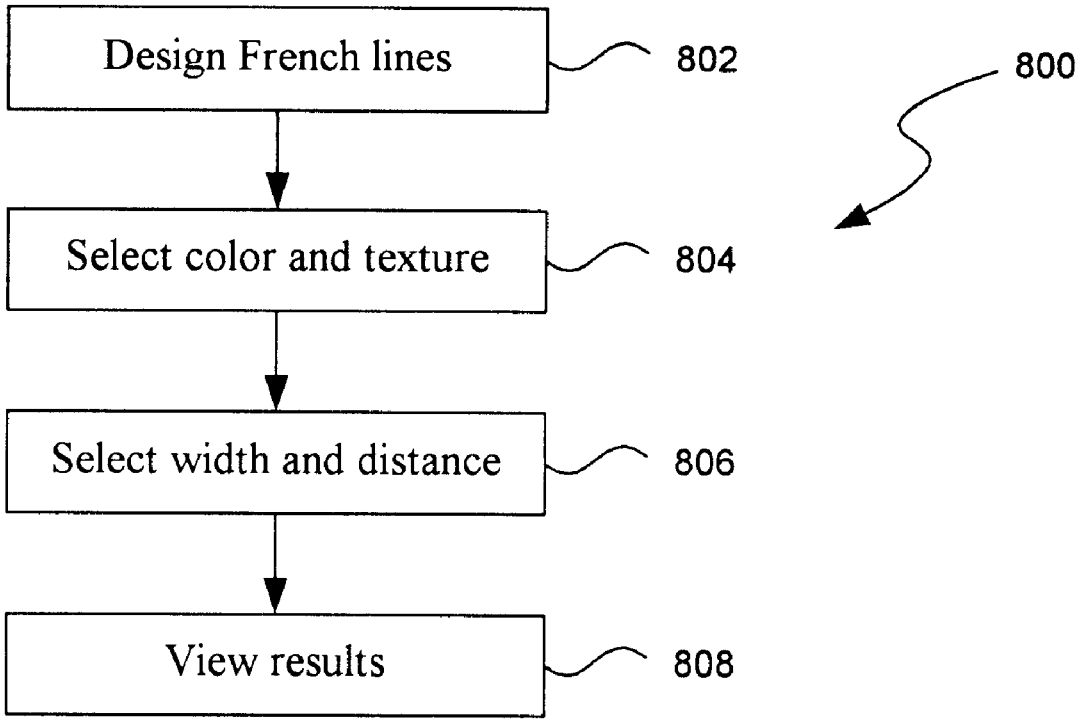
FIG. 8 is a flow diagram of a representative implementation of a French line design process performed by the system of FIG. 1 in accordance with an embodiment of the invention.
Figure 9A:
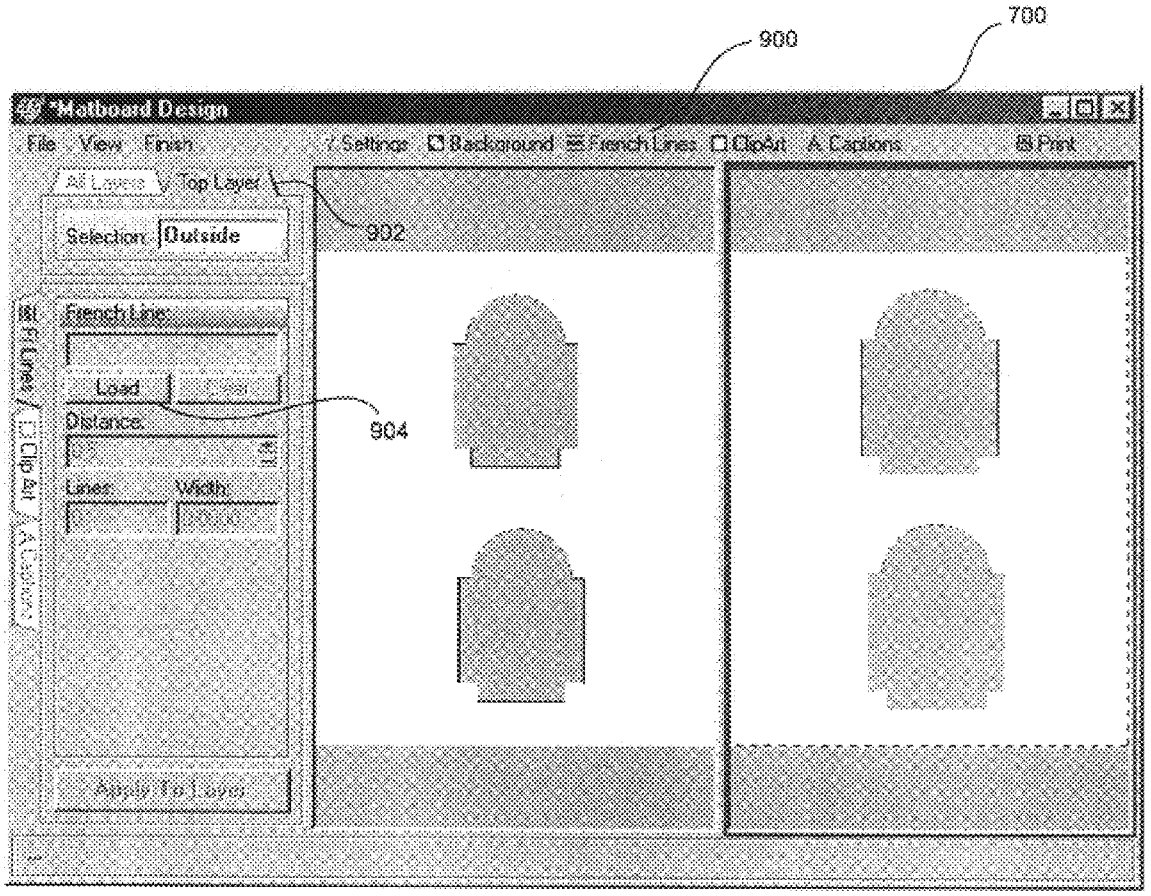
FIGS. 9A–9C together illustrate a display description corresponding to the process outlined in FIG. 8.
Figure 9B:
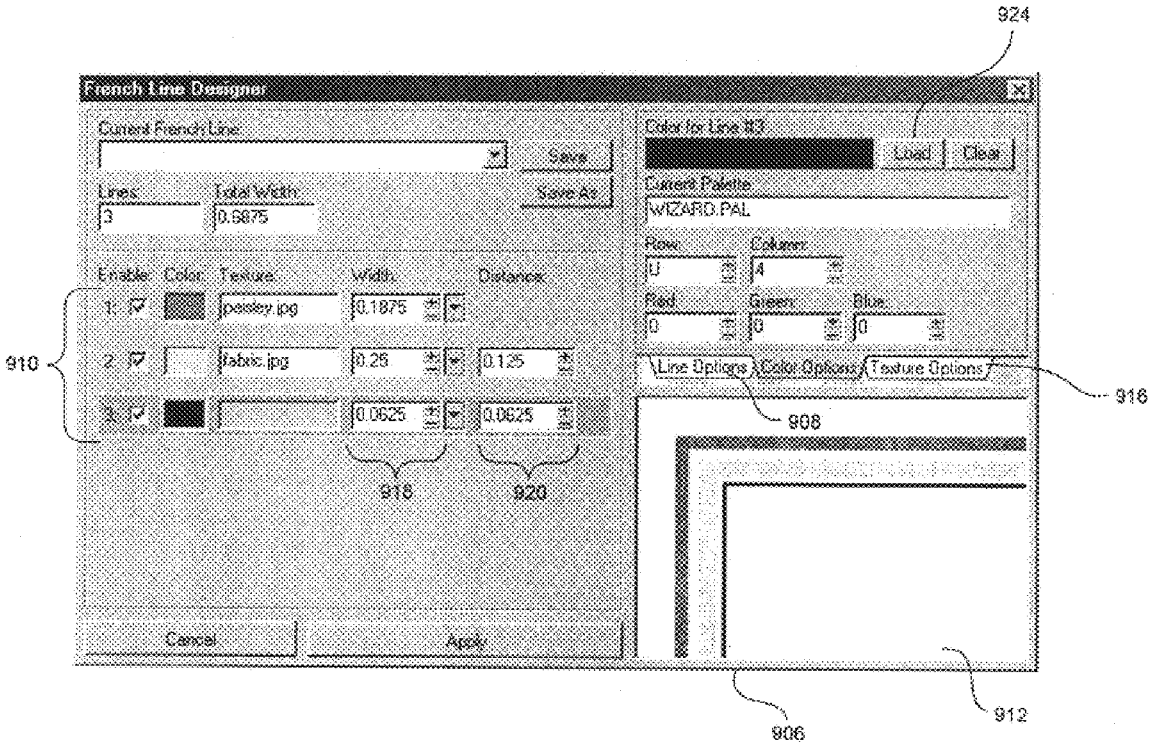
Figure 9C:
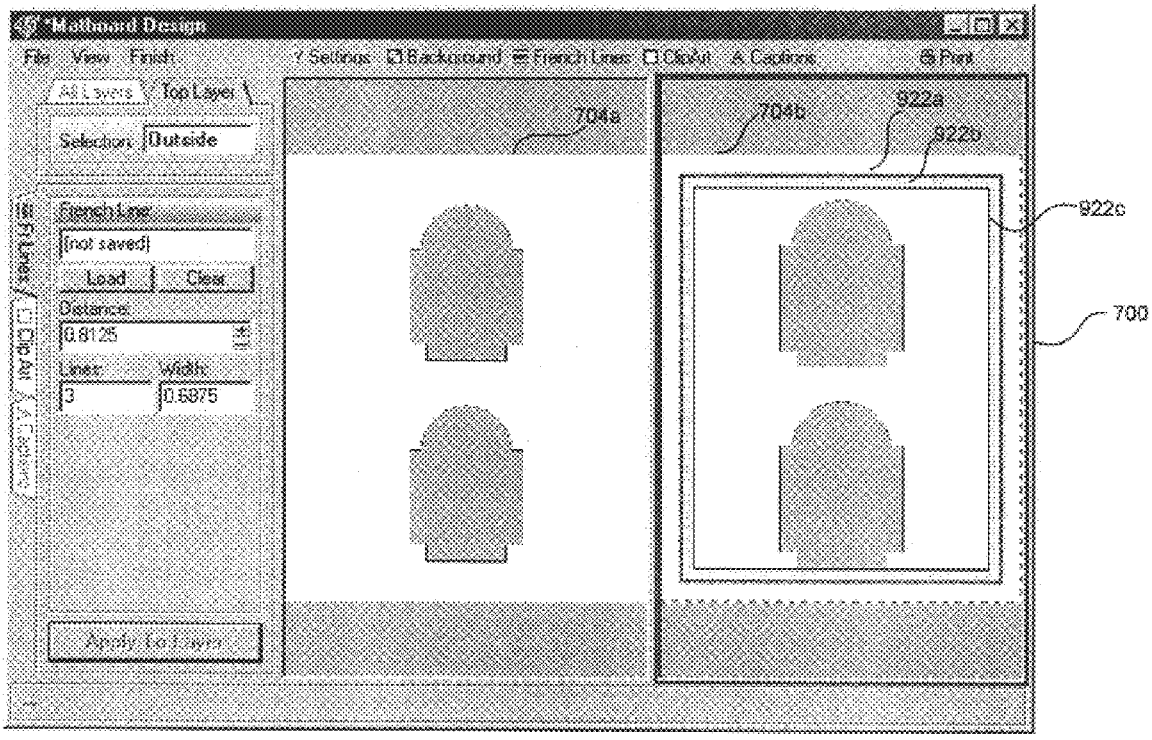

FIG. 8 is a flow diagram of a French line design process 800 performed by the system described above with reference to FIGS. 1A and 1B in accordance with an embodiment of the invention. In step 802, the user initiates a French line design by selecting a French line icon 900 displayed on the mat board design page 700 (FIG. 9A). The user selects the layer or layers to which the French line will be applied by clicking on a layers tab 902 and then clicks a load button 904 to bring up a French line designer page 906 (FIG. 9B). By clicking on a line option tab 908, the user can elect to create any number of new lines or can cut, copy or delete existing lines. Characteristics for all the lines are then shown on the French line designer page 906 in a text field 910. A pictorial representation of the French lines is shown in a view field 912 (step 808). For each French line (three are shown in FIG. 9B), the user can enter the French line color (step 804) by clicking on a load color button 914 to bring up a display similar to that shown in FIG. 7B. The user can then select a texture for each French line by clicking on a texture (step 804) options tab 916 and entering the location of a desired texture file, in a manner similar to that described above with reference to FIG. 7C. The width of each line can be determined by entering the appropriate value in the width fields 918 (step 806), and the spacing between adjacent French lines can be entered in the appropriate distance fields 920. FIG. 9C shows three French lines 922*a*–922*c* applied to the upper mat board layer 704*b*.

Figure 10:
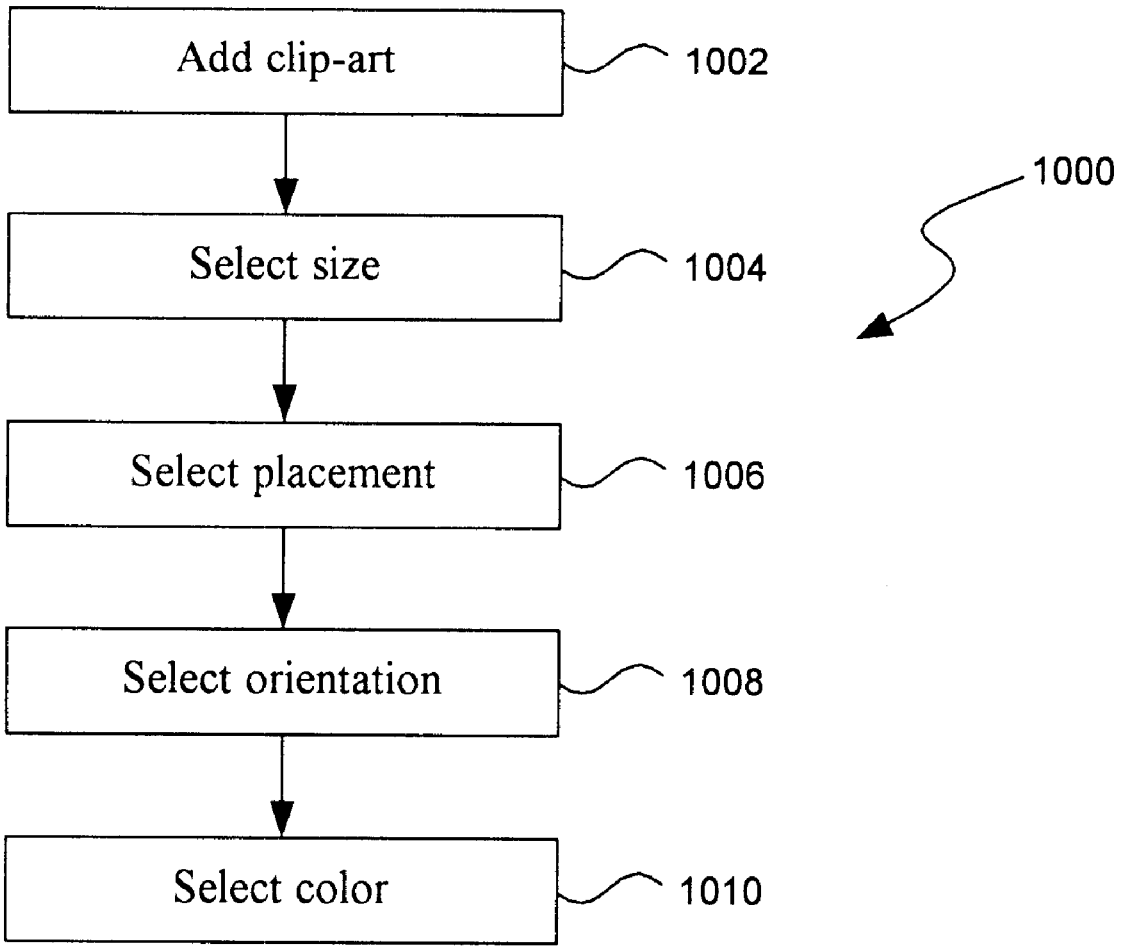
FIG. 10 is a flow diagram of a representative implementation of a clip-art process performed by the system of FIG. 1 in accordance with an embodiment of the invention.
Figure 11A:
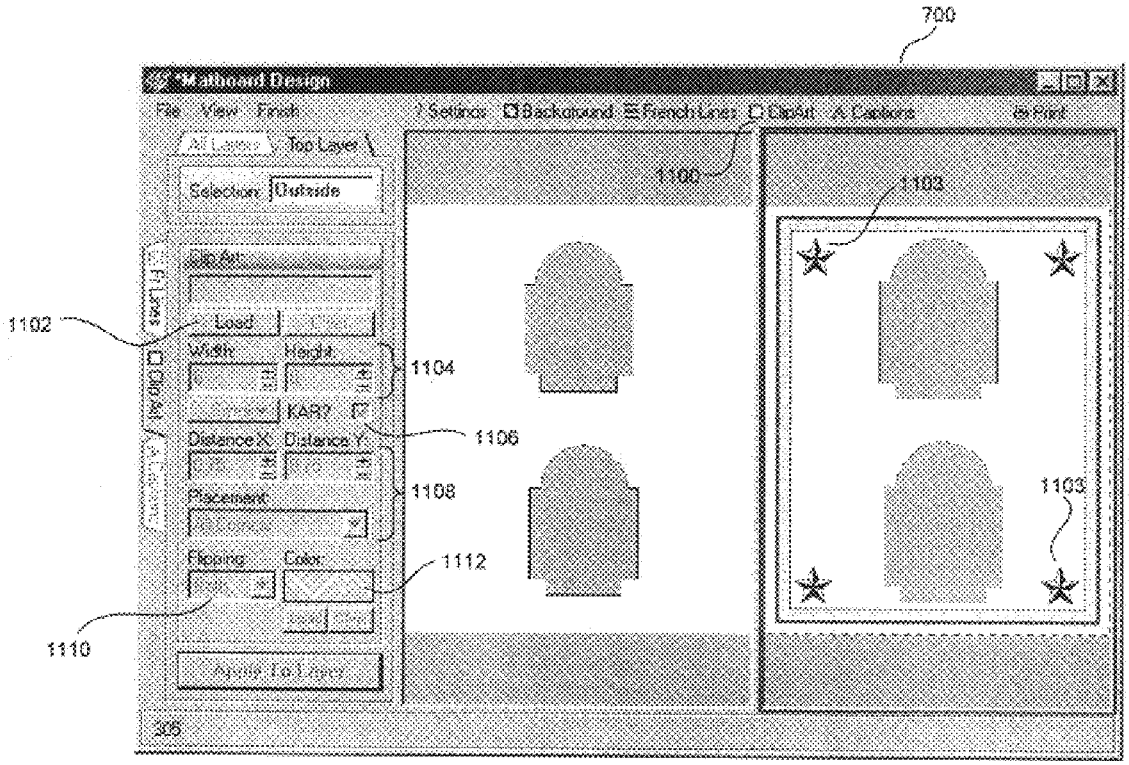
FIGS. 11A–11B together illustrate a display description corresponding to the portion outlined in of FIG. 10.
Figure 11B:
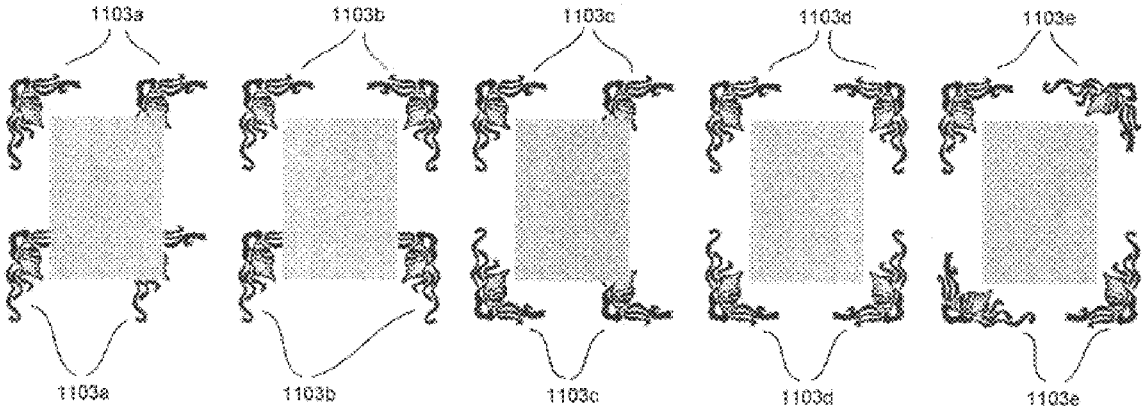

FIG. 10 is a flow diagram of a representative of a clip-art addition process 1000 performed by the system described above with reference to FIGS. 1A and 1B in accordance with an embodiment of the invention. In step 1002, the user initiates the addition process by clicking on a clip-art icon 1100 displayed on the mat board design page 700 (FIG. 11A). The user can apply clip-art to each layer of the mat board by clicking on a load button 1102 to load clip-art 1103. The user can adjust the width and height of the clip-art 1103 (step 1004) by entering the appropriate numbers in the width and height fields 1104. The user can also specify whether the aspect ratio is to be kept constant by clicking on the aspect ratio button 1106, and can position the clip-art on the mat board (step 1006) by specifying x and y distances placement (e.g., relative to the openings 561 or the outer edge of the mat board) in the appropriate fields 1108. The user can also flip the clip-art (step 1008) about one or more axes by clicking on the flip button 1110 to produce a variety of flipped clip-art patterns 1103*a*–1103*e* (shown in FIG. 11B), and can color the clip-art by clicking a color button 1112.

Figure 12:
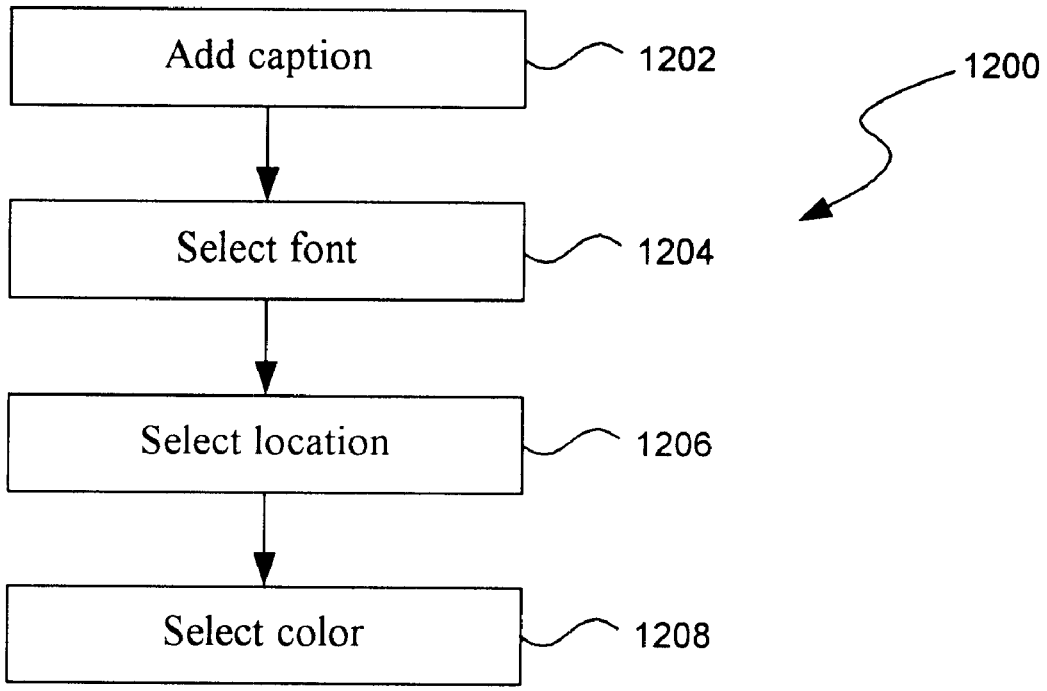
FIG. 12 is a flow diagram of a representative implementation of a caption labeling process performed by the system shown in FIG. 1 in accordance with an embodiment of the invention.

FIG. 12 is a flow diagram of a representative caption addition process 1200 performed by the system described above with reference to FIG. 1A and 1B in accordance with another embodiment of the invention. In step 1202, the user initiates the caption addition process by clicking on a caption icon 1302 of the mat board design page 700 shown in FIG. 13. The user enters text in a text field 1304 and in step 1204, selects a font and size for the text, as shown in field 1306. In step 1206, the user selects a location for the text by entering values in the appropriate location fields 1308, and in step 1208, the user selects a color for the text by clicking on the load color button 1310 to bring up a color menu similar to that described above with reference to FIG. 7B.

Figure 13:
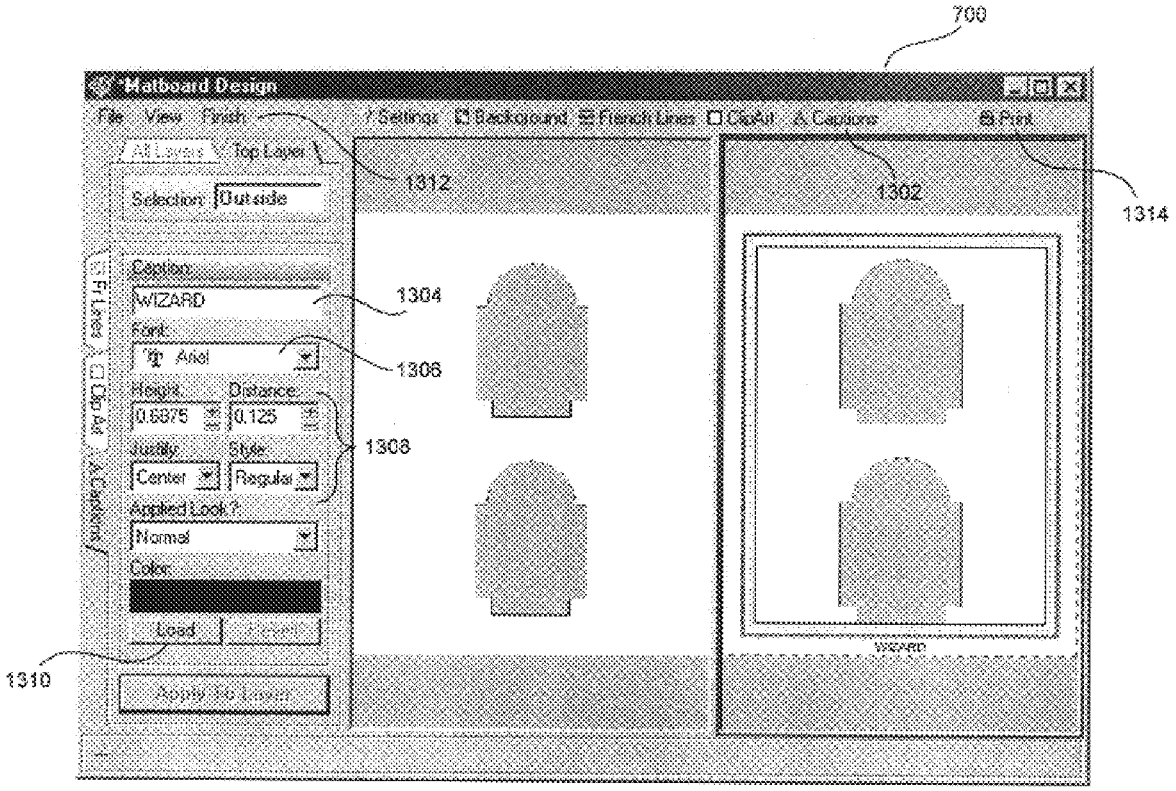
FIG. 13 illustrates a display description corresponding to the caption labeling process outlined in FIG. 12.
Figure 14:
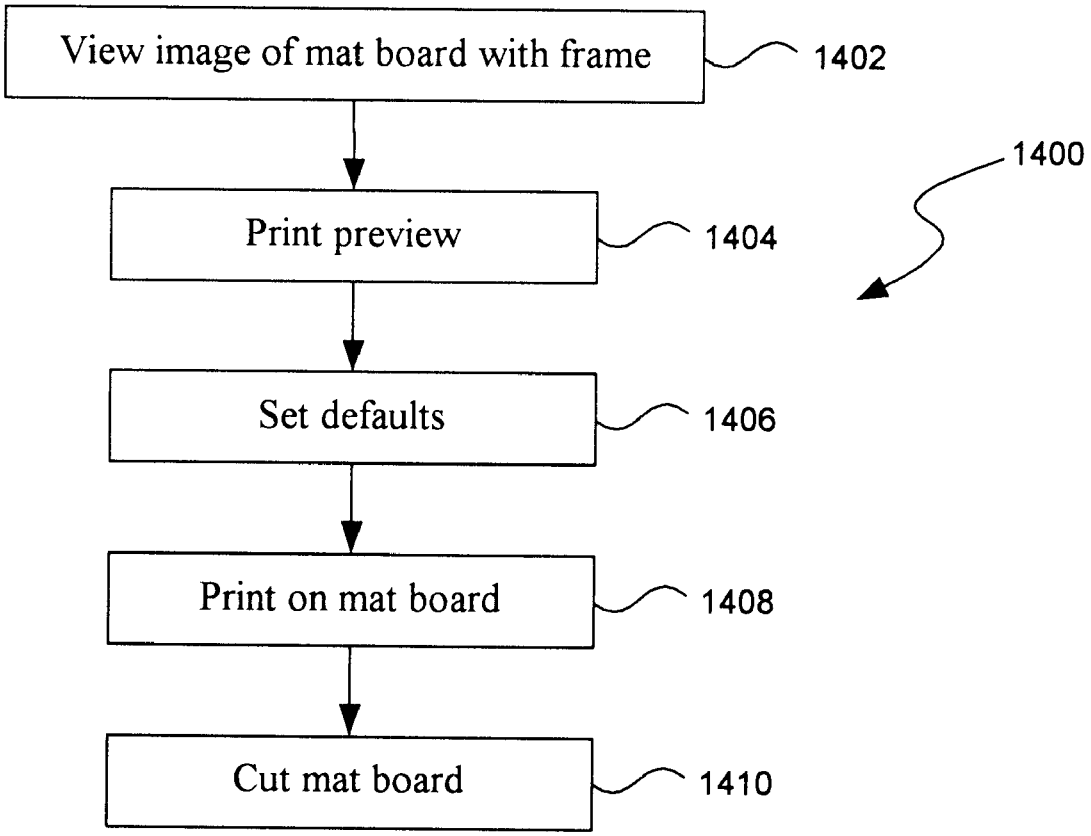
FIG. 14 is a flow diagram of a representative implementation of a printing and cutting portion of a process performed by the system shown in FIG. 1 in accordance with an embodiment of the invention.

FIG. 14 is a flow diagram of a representative printing and cutting process 1400 performed by the system described above with reference to FIGS. 1A and 1B in accordance with an embodiment of the invention. In step 1402, the user views an image of a mat board 120 with a selected frame by first clicking on the finish drop-down menu 1312 shown on FIG. 13 and selecting a "visualize" button. The system then displays a visualization page 1500 shown in FIG. 15A. The visualization page 1500 also appears when the user clicks on the studio icon 308 (FIG. 3). The user previews an image of the mat board 120 (including fillets of the mat board 120) and can add a frame by selecting a frame file in a frame field 1502. The image can also include a digital image of the picture 130 (FIG. 1A), positioned in the opening 128 of the mat board 120, which the user obtains from a separate image file. The user can then print out (for example, on conventional printer paper) a hardcopy of the mat board 120, the frame, and the image of the picture 130 framed by the mat board 120 and the frame.

In one aspect of this embodiment, the user can define the background printed on the mat board 120 to include the digital image of the picture 130, or a portion of the picture 130. For example, the user can define the color of the mat board 120 to be an average of the color over a portion of the picture image. The picture image can also form the texture of the background section either in whole or in part. For example, a portion of the picture image can be repeated to form a tile pattern or a kaleidoscope pattern. The picture image can be stretched, rotated or otherwise manipulated to define the background of the mat board 120.

Figure 15A:
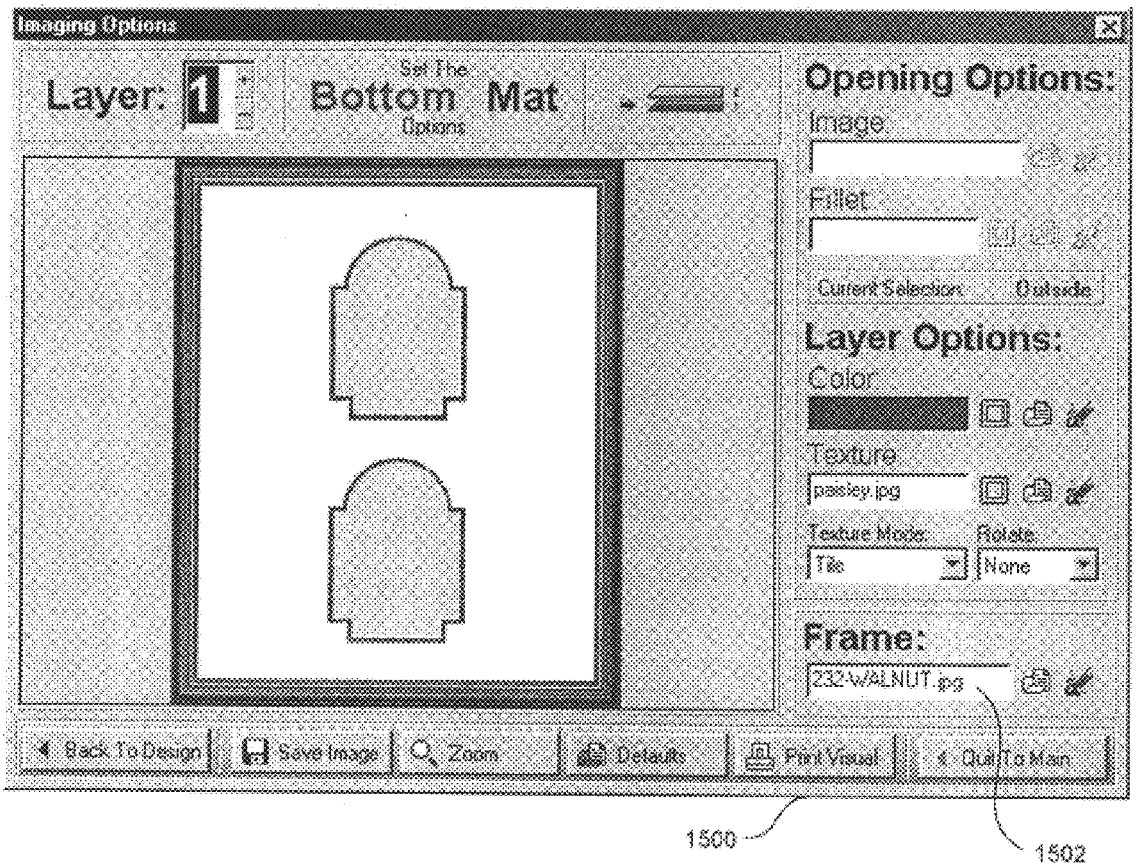
FIGS. 15A–15E together illustrate a display description corresponding to the process outlined in FIG. 14.
Figure 15B:
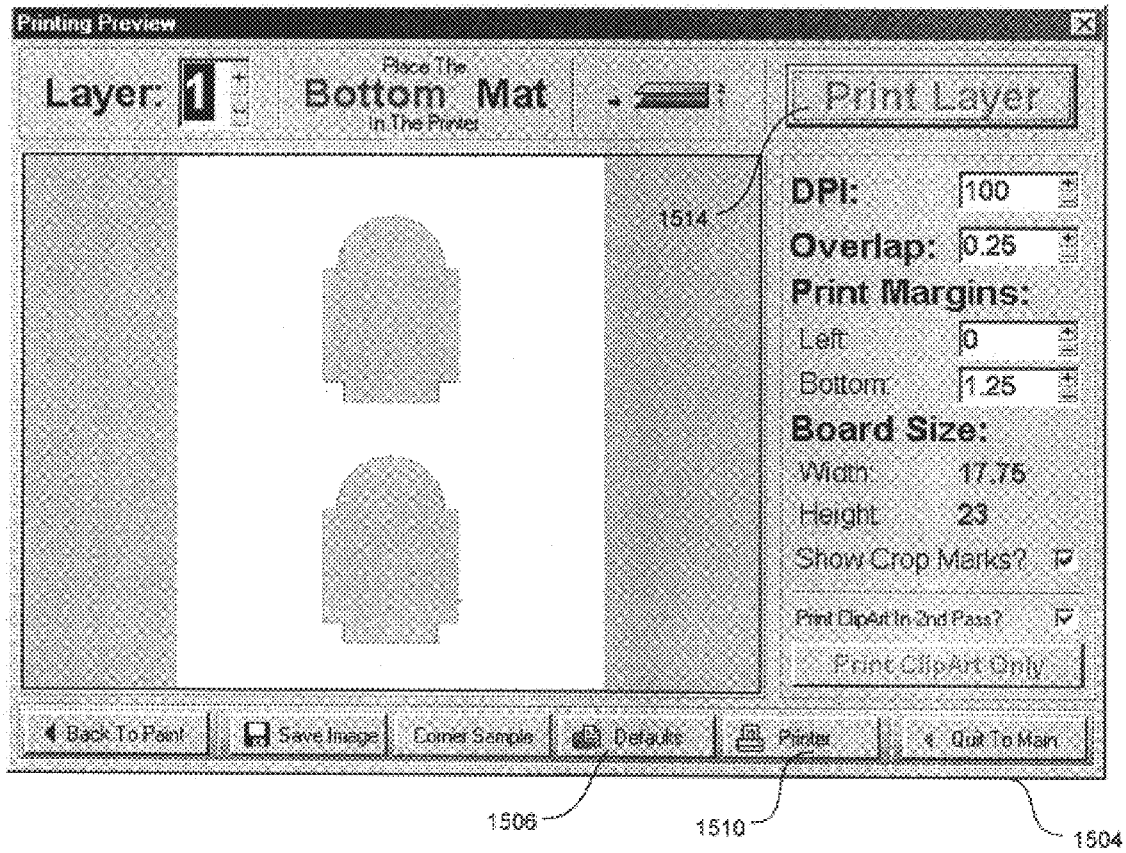
Figure 15C:
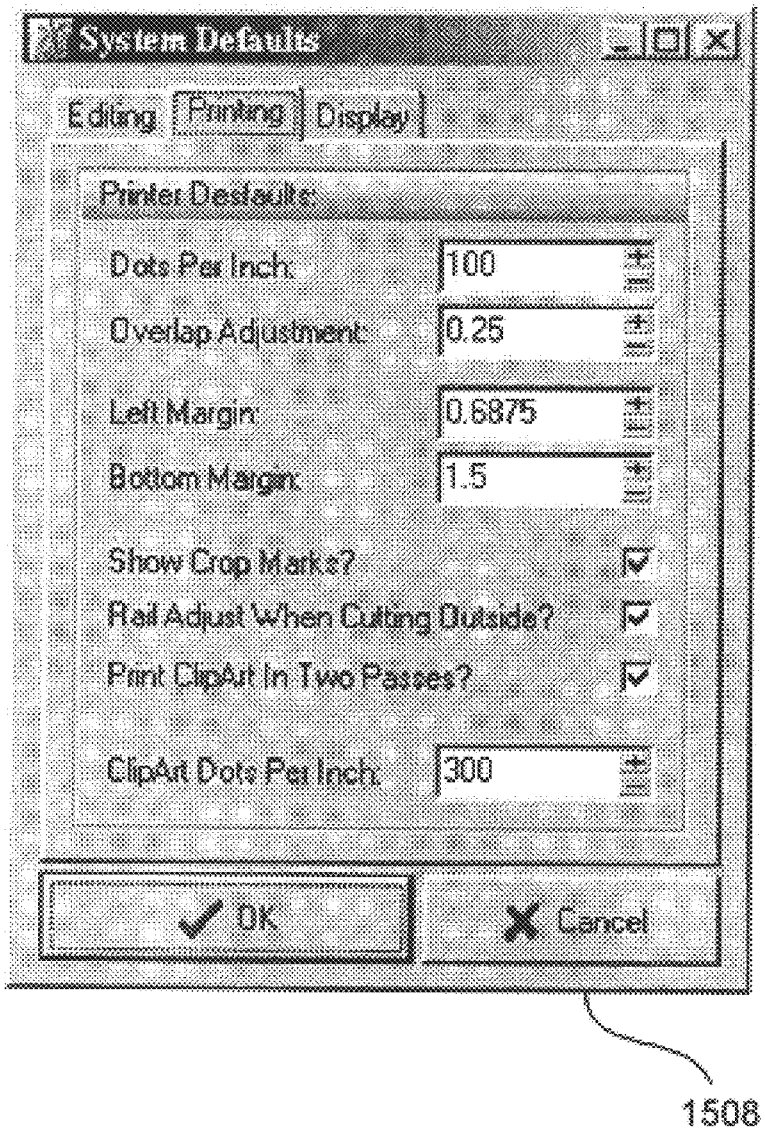
Figure 15D:
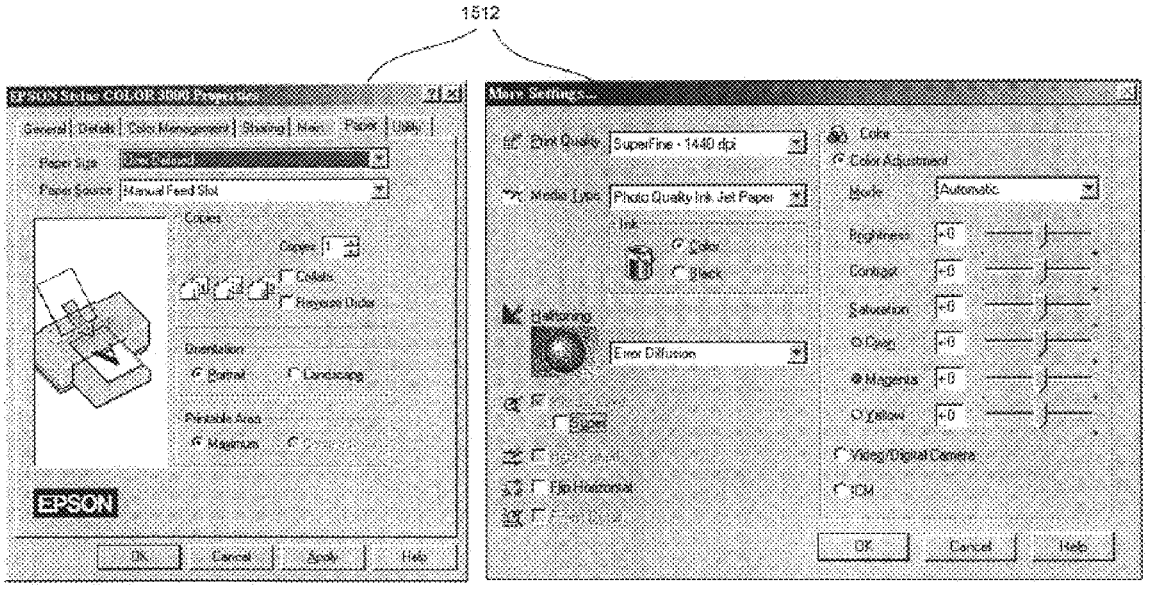
Figure 15E:
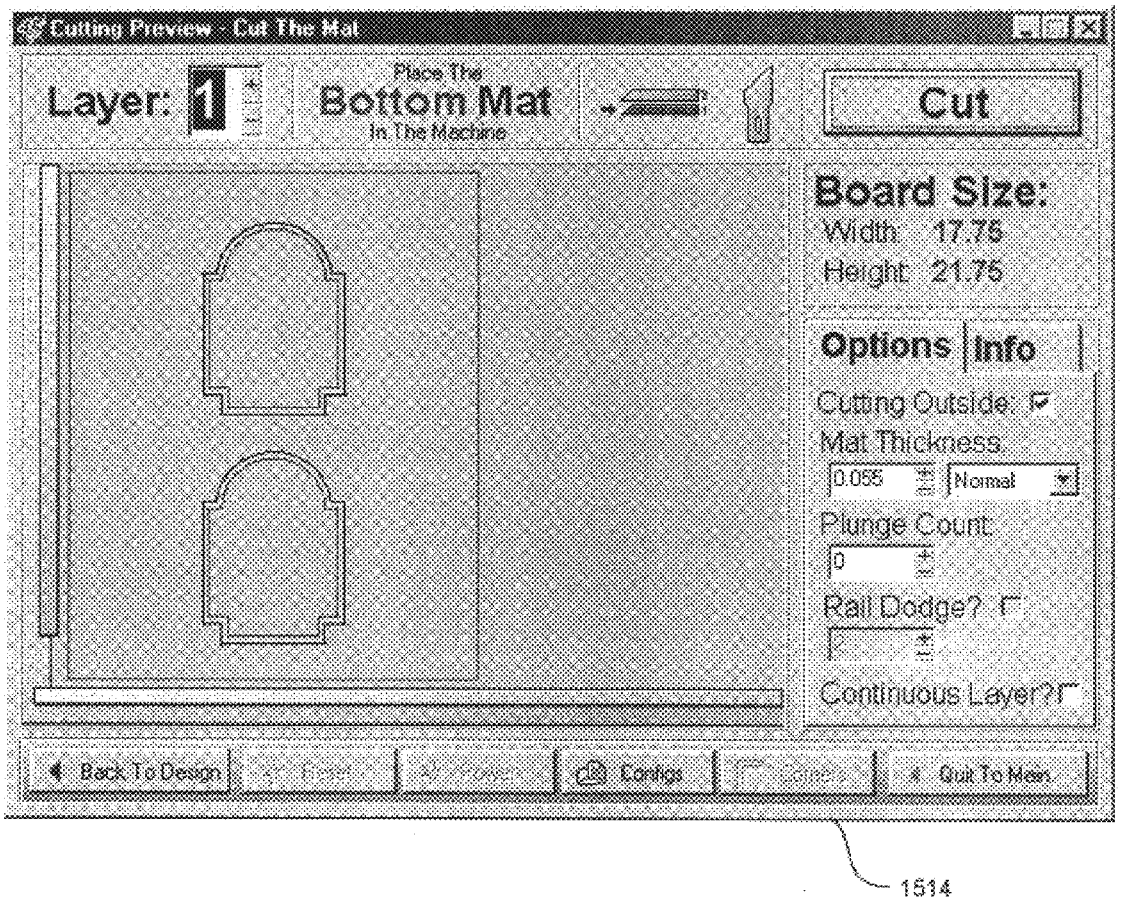

In step 1404, the user can preview the printed mat board by clicking on the print icon 1314 shown in FIG. 13 to display a print preview window 1504. The print preview window 1504 does not display a frame, but displays the mat board design exactly as it will appear on the printed mat board. The user can adjust printer defaults (step 1406) by clicking on a defaults button 1506 to bring up a defaults screen 1508, shown in FIG. 15C. The user can select such printer default values as the number of dots per inch, the overlap adjustment, left and bottom margins, whether crop marks are shown, whether clip-art is printed in a separate, high resolution pass and how many dots per inch the clip-art is printed at. For example, the user can set the overlap adjustment for an upper layer 704*b* (FIG. 7A) to extend from the outer edge of the mat board to the edges of the upper openings 561*b*, or a specified distance inside the upper openings 561*b*. The user can set the overlap adjustment for the lower layer 561*a* (FIG. 7A) to cover just the rim region 706, or the rim region 706 plus an additional margin just inside and/or outside the rim region if desired. The user then clicks on a printer button 1510 shown in FIG. 15B to bring up a printer page 1512, shown in FIG. 15D. The printer page 1512 displays additional printer-specific parameters that the user can adjust. To print each layer, the user clicks on a print layer button 1514 (FIG. 15B).

In one embodiment, the printer 110 (FIG. 1A) is a Color 3000 or Color 9000 ink jet printer available from Epson, Inc. of Long Beach, Calif. In other embodiments, other suitable printers can be used (e.g., other ink jet printers, or other types of printers, such as laser printers), so long as the printers are capable of handling mat boards 120 having suitable mat board dimensions. For example, the mat board 120 can have a thickness of from about 0.040 inch to about 0.100 inch in one embodiment and can have other thicknesses in other embodiments. In one aspect of this embodiment, the printer 110 supports a rear surface of the mat board 120 while the front surface is printed. In a further aspect of this embodiment, the printer can handle mat boards having a minimum size of approximately four inches by six inches or less and/or a maximum size of 44 inches by 100 feet. In other embodiments, other printers having other mat board size capabilities can be used.

In still another embodiment of the invention, the mat board 120 can include a relatively stiff coreboard 134 with a vellum backing 136 at the rear surface, to prevent warping. A sheet of ink-jet compatible paper 138 (or another paper that produces at least approximately photographic quality images when imprinted with an ink jet printer) is laminated to the front surface of the coreboard 134 opposite the backing 136 to receive the printed image. Suitable paper includes presentation mat paper, available from Epson, Inc. Alternatively, the front surface of the coreboard 134 can be treated to be ink jet compatible. In either embodiment, the front surface of the mat board 120 (i.e., the surface that receives the printed image) can include a hydrophilic binder polymer, a cross-linked polyvinyl alcohol, a polymeric binder, and insolublized hydrophilic polymer, and/or a water soluble latex polymer. Alternatively, the print-receiving surface can include other chemical compositions, so long as the print receiving surface is at least partially nonporous (to allow the ink to soak in) without being so porous the ink "bleeds" laterally at the surface, which can blur the lines defining the image.

Once the mat board 120 has been printed, it can be cut (step 1410), by mounting the printed mat board 120 in the cutter apparatus 112 shown in FIG. 1A and accessing a cut page 1514 (FIG. 15E) displayed by the computer 102. The user can send the appropriate signals to the cutter apparatus 112 via input buttons on the cut page 1514, in accordance with process steps described in greater detail in the concurrently filed provisional patent application titled "Method and Apparatus for Printing," incorporated herein by reference. Once the mat board 120 has been cut, it can be mounted with the frame 132 and the picture 130 or other medium in a conventional manner. In an alternate embodiment, the mat board 120 can be cut before it is printed.

In one aspect of an embodiment of the process described above, the information generated during the mat board design process is saved in a permanent file on a computer-readable medium, and can be retrieved later and used or modified as the user sees fit. Such storage and retrieval mechanisms are well-known in the art and are not described further herein.

An advantage of an embodiment of the system and process described above with reference to FIGS. 1–15E is that the printer 110 prints computerized images directly on the mat board 120. Accordingly, users need not apply color, French lines, clip-art or text to the mat board 120 by hand. As a result, the skill level required to complete the mat boards 120 can be less than with conventional techniques. Furthermore, users, such as frame shop owners and employees, need not maintain a large inventory of pre-colored mat boards, but can instead stock a single neutrally colored mat board (such as a white mat board) and print on the mat board colors and designs that are tailored to a specific combination of frame and picture. Accordingly, a single type of mat board can be maintained in stock and yet be compatible with a multitude of frames and pictures or other art items.

From the foregoing, it will be appreciated that, although specific embodiments of the invention have been described herein for the purposes of illustration, various modifications may be made without deviating from the spirit and scope of the invention. Accordingly, the invention is not limited, except as by the appended claims.

What is claimed is:

1. A method for printing on a mat board used for mounting and/or framing a selected item, comprising:

providing on a computer-readable medium a digital image having a size scaled to a size of the mat board;

transmitting the digital image to a computer printer coupled to the computer-readable medium; and printing the digital image directly on the mat board with the computer printer while the mat board is engaged with the computer printer.

2. The method of claim 1 wherein the mat board has an edge and an interior region inward from the edge that is open or configured to be opened to allow visual access to the selected item when the selected item is placed behind the mat board, the mat board further having a border region between the edge and the interior region, the method further comprising sizing the digital image to be approximately equal in size and shape to the border region.

3. The method of claim 1, further comprising printing the digital image directly on a first surface of the mat board while supporting a second surface of the mat board spaced apart from the first surface by from about 0.040 inch to about 0.100 inch.

4. The method of claim 1, further comprising scanning an image with a computer scanner to provide the digital image.

5. The method of claim 1, further comprising manipulating the digital image by changing at least one of a color, contrast, focus, texture, and brightness of the digital image.

6. The method of claim 1, further comprising manipulating the digital image by forming a repeating pattern of at least a portion of the digital image.

7. The method of claim 1, wherein the selected item includes a picture, further comprising defining the digital image to include a reproduction of at least a portion of the picture.

8. The method of claim 1, further comprising:

defining an outline of the interior region of the mat board;

cutting through the mat board along the outline to define an opening; and placing the mat board proximate to a picture with at least a portion of the picture visually accessible through the opening.

9. The method of claim 1, further comprising:

defining an outline of the interior region of the mat board;

transmitting to an automatic cutting device signals corresponding to a definition of the outline of the interior region;

automatically cutting through the mat board along the outline to define an opening; and placing the mat board proximate to a picture with at least a portion of the picture visually accessible through the opening.

10. The method of claim 1, further comprising:

engaging the mat board with the computer printer before printing the digital image on the mat board;

removing the mat board from the computer printer after printing the digital image on the mat board; and framing a picture with the mat board by placing the picture adjacent to a rearward-facing surface of the mat board, placing a frame adjacent to a forward-facing surface of the mat board and securing the mat board, the picture and the frame as a unit.

11. The method of claim 1 wherein the mat board is a first mat board, further comprising:

printing a digital image directly on a second mat board with a computer printer while the second mat board is engaged with the computer printer;

cutting a first opening in the first mat board and cutting a second opening the second mat board with the first opening having a size different than a size of the second opening; and framing the selected item with the mat boards by placing the item adjacent the first mat board, placing the second mat board adjacent the first mat board, placing a frame adjacent to the second mat board and securing the selected item, the mat boards and the frame as a unit.

12. A method for using a computer to print on a mat board for framing a picture, comprising:

providing a bit-mapped image to the computer;

providing first instructions to the computer to size the bit-mapped image to fit between an outer edge of the mat board and an interior portion of the mat board configured to be cut out from the remainder of the mat board;

providing second instructions to the computer to manipulate at least one of a selected size, shape, color, style, and orientation of the bit-mapped image;

instructing the computer to transmit the bit-mapped image to a computer printer;

printing the bit-mapped image directly on the mat board with the computer printer; and removing the mat board from the computer printer.

13. The method of claim 12, further comprising:

mounting the mat board in an automated cutting device;

transmitting instructions to the automated cutting device relating to the size of the interior region of the mat board; and automatically cutting the interior region from the mat board using the automated cutting device.

14. The method of claim 12, further comprising printing the digital image directly on a first surface of the mat board while supporting with the computer printer a second surface of the mat board spaced apart from the first surface by from about 0.040 inch to about 0.100 inch.

15. The method of claim 12, further comprising selecting the image to include at least one of a background, a French line, clip-art and a caption.

16. A computer-readable medium the contents of which cause a computer system to perform a method for defining an image for printing on a mat board, the method comprising:

accessing a digital image having a size and shape approximately the same as a size of a border region of the mat board, the border region being located between an outer edge of the mat board and an interior region of the mat board that is cut out or configured to be cut out to allow visual access to an item behind the mat board; and transmitting the digital image to a computer printer for printing directly on the mat board.

17. The computer-readable medium of claim 16, further comprising reading an analog image by scanning the image with an electronic scanner and mapping the analog image to a digital format to form the digital image.

18. The computer-readable medium of claim 16, further comprising displaying characteristics of the digital image on a computer display.

19. The computer-readable medium of claim 16, further comprising receiving an input signal to manipulate the digital image before transmitting the digital image to the computer printer.

20. The computer-readable medium of claim 16, further comprising:

receiving an input signal to manipulate the digital image; and manipulating the digital image by changing at least one of a color, contrast, focus, texture, and brightness of the digital image before transmitting the digital image to the printer.

21. The computer-readable medium of claim 16, further comprising defining the digital image to include a reproduction of at least a portion of a picture configured to be mounted adjacent to the mat board.

22. The computer-readable medium of claim 16, further comprising:

transmitting to an automatic cutting device signals corresponding to a definition of an outline of the interior region; and automatically cutting through the mat board with the automatic cutting device along the outline to define an opening.

23. The computer-readable medium of claim 16, further comprising:

instructing the computer printer to print the digital image directly on the mat board.

24. A computer-readable medium the contents of which cause a computer system to perform a method for printing on a mat board, the method comprising:

accessing a digital image;

transmitting the digital image to a computer printer for printing the image on the mat board;

transmitting a first command to the computer printer to print the digital image on the mat board; and transmitting a second command to a cutter device to cut an interior region from the mat board.

25. The computer-readable medium of claim 24, further comprising configuring the digital image to have a size and shape approximately the same as a size and shape of a border region of the mat board, the border region positioned between an outer edge of the mat board and an interior region of the mat board that is cut out or configured to be cut out to allow visual access to an item behind the mat board.

26. The computer-readable medium of claim 24 wherein accessing the digital image includes accessing a digital image having a size corresponding to a size of a border region of the mat board between an edge of the mat board and an interior region of the mat board that is configured to be cut out to allow visual access to an item behind the mat board.

27. The computer-readable medium of claim 24, further comprising:

receiving an input signal related to the size of a border region between an edge of the mat board and an interior region of the mat board that is cut out or configured to be cut out to allow visual access to an item positioned behind the mat board; and sizing the digital image to have a size approximately equal to the size of the border region.

28. The computer-readable medium of claim 24, further comprising:

receiving an input signal related to the size of a border region between an edge of the mat board and an interior region of the mat board that is cut out or configured to be cut out to allow visual access to an item positioned behind the mat board; and sizing the digital image to have a size and shape that extends from the edge of the mat board at least partially into the interior region of the mat board.

29. The computer-readable medium of claim 24, further comprising receiving an input signal to manipulate the digital image before transmitting the digital image to the computer printer.

30. A computer-readable medium having contents that cause a computer system to perform a method for defining an image for printing on a mat board, the method comprising:

receiving an indication of a first digital image;

receiving an indication of a size and shape of a border region of a mat board between an outer edge of the mat board and an interior portion of the mat board that is either cut out or configured to be cut out; and defining a second digital image by adapting the first digital image to correspond to the border region of the mat board.

31. The computer-readable medium of claim 30, further comprising defining a size and shape of the second digital image to extend from the outer edge of the mat board at least partially into the interior portion of the mat board.

32. The computer-readable medium of claim 30, further comprising defining the second digital image to have a size and shape approximately the same as a size and shape of the border region.

33. The computer-readable medium of claim 30, further comprising receiving an input signal to manipulate the digital image before transmitting the digital image to the computer printer.

34. The computer-readable medium of claim 30, further comprising:

transmitting to an automatic cutting device signals corresponding to a definition of an outline of the interior region; and automatically cutting through the mat board with the automatic cutting device along the outline to define an opening in the mat board.

35. The computer-readable medium of claim 30, further comprising transmitting the second digital image to a computer printer for printing directly on the mat board.

36. A computer-implemented method for printing on a mat board used for mounting and/or framing a selected item, comprising:

receiving an indication of a digital image having a size scaled to a size of the mat board;

transmitting the digital image to a printer under control of the computer; and printing the digital image directly on the mat board.

37. The method of claim 36, further comprising creating the digital image.

38. The method of claim 36, further comprising creating the digital image by defining an outline of the digital image and defining at least one of a color and texture of the digital image.

39. The method of claim 36, wherein the mat board has an edge and an interior region inward from the edge that is open or configured to be opened to allow visual access to the selected item when the selected item is placed behind the mat board, the mat board further having a border region between the edge and the interior region, the method further comprising sizing the digital image to be approximately equal in size and shape to the border region.

* * * * *

UNITED STATES PATENT AND TRADEMARK OFFICE

CERTIFICATE OF CORRECTION

PATENT NO. : 6,450,090 B1
DATED : September 17, 2002
INVENTOR(S) : Wilbur S. Wridge, Jr.

It is certified that error appears in the above-identified patent and that said Letters Patent is hereby corrected as shown below:

Column 2,
Line 34, “e.g,” should be -- e.g., --;

Column 8,
Line 50, insert paragraph break after ““paint mat.””;

Column 11,
Line 51, “nonporous” should be -- non-porous --.

Signed and Sealed this

Sixth Day of May, 2003

JAMES E. ROGAN
*Director of the United States Patent and Trademark Office*